US011487218B2

(12) United States Patent
Yamagishi et al.

(10) Patent No.: US 11,487,218 B2
(45) Date of Patent: Nov. 1, 2022

(54) IMAGE FORMING APPARATUS THAT CALCULATES SURFACE POTENTIAL OF IMAGE CARRIER ACCORDING TO DEVELOPING CURRENT

(71) Applicant: KYOCERA Document Solutions Inc., Osaka (JP)

(72) Inventors: Yoshihiro Yamagishi, Osaka (JP); Tamotsu Shimizu, Osaka (JP); Kazunori Tanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/362,948

(22) Filed: Jun. 29, 2021

(65) Prior Publication Data

US 2022/0004116 A1 Jan. 6, 2022

(30) Foreign Application Priority Data

Jul. 2, 2020 (JP) ..... JP2020-114846
Jul. 2, 2020 (JP) ..... JP2020-114847

(51) Int. Cl.
*G03G 15/06* (2006.01)
*G03G 15/00* (2006.01)
*G03G 15/02* (2006.01)

(52) U.S. Cl.
CPC ..... *G03G 15/065* (2013.01); *G03G 15/5037* (2013.01); *G03G 15/0266* (2013.01)

(58) Field of Classification Search
CPC ..... G03G 15/065; G03G 15/5037; G03G 15/0266
See application file for complete search history.

(56) References Cited

U.S. PATENT DOCUMENTS

2016/0334734 A1* 11/2016 Kaneko ..... G03G 15/065

FOREIGN PATENT DOCUMENTS

JP 2003-295540 A 10/2003

* cited by examiner

*Primary Examiner* — Arlene Heredia
(74) *Attorney, Agent, or Firm* — IP Business Solutions, LLC

(57) ABSTRACT

An image forming apparatus includes an image carrier, a charging device, a developing device, a developing power source, a current measuring device, and a processor. On a surface of the image carrier, an electrostatic latent image is formed. The charging device electrically charges the image carrier. The developing device forms a toner image, by supplying toner to the image carrier and developing the electrostatic latent image formed on the image carrier. The developing power source applies a predetermined bias voltage to the developing device. The current measuring device measures a developing current flowing in the developing device. The processor acts, by executing a control program, as a calculator that calculates a surface potential of the image carrier, on a basis of the developing current measured by the measuring device.

11 Claims, 22 Drawing Sheets

Fig.10

| | BIAS VOLTAGE [V] | DEVELOPING CURRENT [μA] |
|---|---|---|
| JOB 1 | 240 | −0.16 |
| JOB 2 | 300 | 0.11 |
| JOB 3 | 360 | 0.31 |

Fig.18

| | BIAS VOLTAGE [V] | DEVELOPING CURRENT [μA] |
|---|---|---|
| FIRST BLANK FORMING PERIOD | 240 | −0.16 |
| SECOND BLANK FORMING PERIOD | 300 | 0.11 |

IMAGE FORMING APPARATUS THAT CALCULATES SURFACE POTENTIAL OF IMAGE CARRIER ACCORDING TO DEVELOPING CURRENT

INCORPORATION BY REFERENCE

This application claims priority to Japanese Patent Application No. 2020-114846 and No. 2020-114847 filed on Jul. 2, 2020, the entire contents of which are incorporated by reference herein.

BACKGROUND

The present disclosure relates to an image forming apparatus.

In image forming apparatuses based on electrophotography, such as a copier and a printer, an image forming process including applying a toner to an electrostatic latent image, formed by exposing the surface of a uniformly charged photoconductor drum (image carrier), and developing the latent image into a toner image, is widely employed. To obtain a high-quality image, it is required to develop the image with a development bias having an appropriate potential difference, with respect to the surface potential of the photoconductor drum.

Therefore, it is necessary to detect the actual surface potential of the photoconductor drum to be used for the image forming. For this purpose, a surface potential sensor has thus far been employed, to detect the surface potential of the photoconductor drum.

However, the surface potential sensor is expensive. In addition, for example when the toner that has splashed is stuck to the surface potential sensor, the sensor may fail to accurately detect the surface potential. Accordingly, some techniques have been proposed, to acquire the surface potential of the photoconductor drum, without depending on the surface potential sensor, which is expensive.

For example, an electrophotography apparatus has been proposed, configured to form a pulsed electrostatic potential pattern on a photosensitive body, applying a bias to a developing roller, and measuring the current flowing from the photosensitive body to the developing roller when developing the electrostatic potential pattern, thereby acquiring the surface potential on the photosensitive body. More specifically, the surface potential on the photosensitive body is estimated, by monitoring the current at a point where the pulsed electrostatic potential pattern is switched. Through such an arrangement, the surface potential on the photosensitive body can be acquired, without using the surface potential sensor.

SUMMARY

The disclosure proposes further improvement of the foregoing technique. In an aspect, the disclosure provides an image forming apparatus including an image carrier, a charging device, a developing device, a developing power source, a current measuring device, and a processor. On a surface of the image carrier, an electrostatic latent image is formed. The charging device electrically charges the image carrier. The developing device forms a toner image, by supplying toner to the image carrier and developing the electrostatic latent image formed on the image carrier. The developing power source applies a predetermined bias voltage to the developing device. The current measuring device measures a developing current flowing in the developing device. The processor acts, by executing a control program, as a calculator that calculates a surface potential of the image carrier, on a basis of the developing current measured by the measuring device.

BRIEF DESCRIPTION OF THE DRAWINGS

FIG. 10 is a table showing the average of the developing current with respect to each job, measured when three levels of the bias voltages are applied to a developing roller, during execution of jobs 1 to 3 by an image forming apparatus according to a first working example;

FIG. 18 is a table showing the developing current measured when two levels of the bias voltages are applied to the developing roller, during a first blank forming period and a second blank forming period by an image forming apparatus according to a second working example;

DETAILED DESCRIPTION

Figure 1:
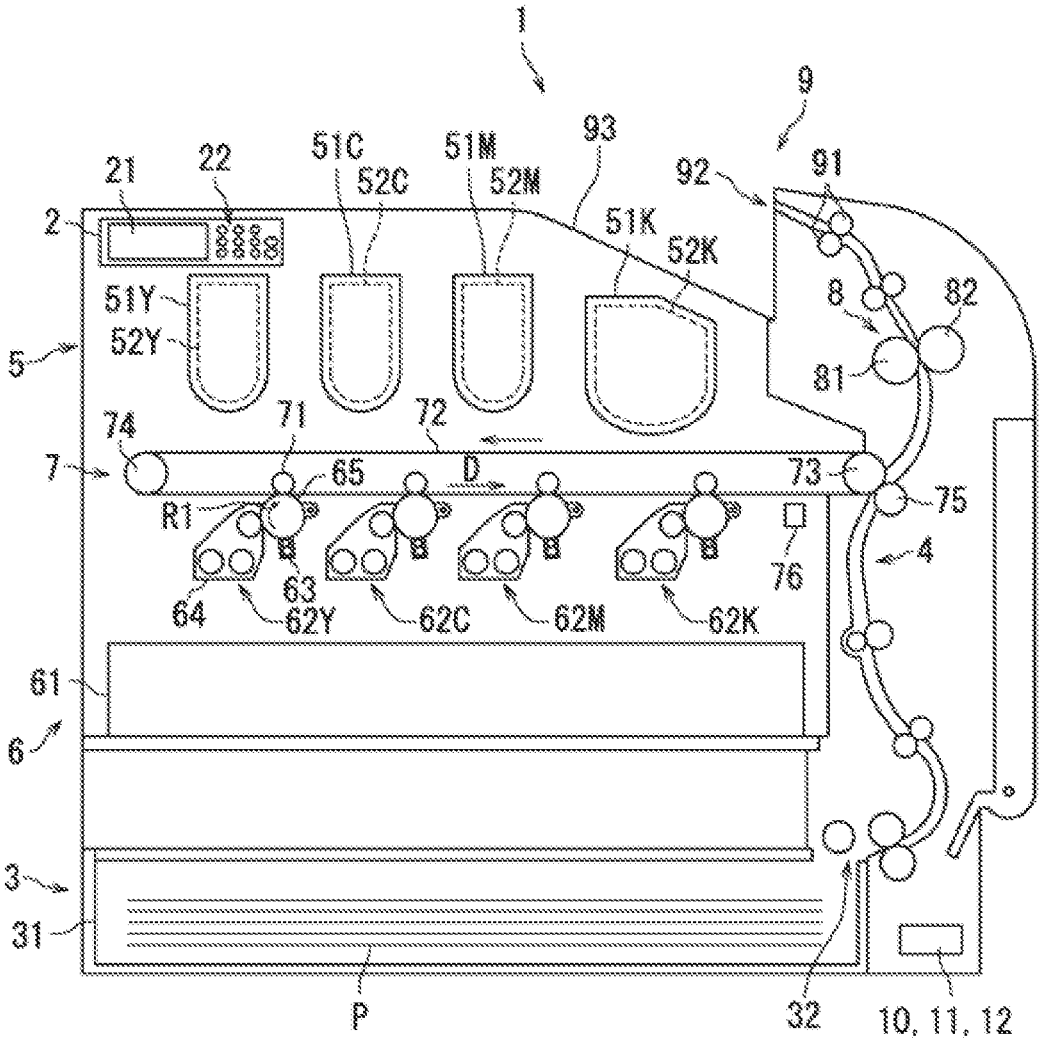
FIG. 1 is a schematic cross-sectional view showing a configuration of an image forming apparatus.

Hereafter, embodiments of the disclosure will be described, with reference to the drawings. In the drawings, the same or corresponding elements are given the same numeral, and the description thereof will not be repeated.

First Embodiment

Referring to FIG. 1, a configuration of an image forming apparatus 1 according to a first embodiment of the disclosure will be described. FIG. 1 is a schematic cross-sectional view showing the configuration of the image forming apparatus 1. The image forming apparatus 1 is, for example, a tandem-type color printer.

As shown in FIG. 1, the image forming apparatus 1 includes an operation device 2, a paper feeding device 3, a transport mechanism 4, a toner supply device 5, an image forming device 6, a transfer device 7, a fixing device 8, a discharge device 9, and a control device 10.

The operation device 2 receives instructions from a user. Upon receipt of the instruction from the user, the operation device 2 transmits a signal indicating the user's instruction to the control device 10. The operation device 2 includes an LCD 21 and a plurality of operation keys 22. The LCD 21 displays, for example, results of various types of processings. The operation keys 22 include, for example, a tenkey and a start key. The operation unit 2, when an instruction indicating the execution of the image formation processing is input, transmits a signal indicating the execution of the image forming processing to the control device 10. As a result, the control device 10 starts the image forming operation by the image forming apparatus 1.

The paper feeding device 3 includes a paper cassette 31, and a group of paper feeding rollers 32. The paper cassette 31 is configured to store therein a plurality of sheets P. The paper feeding roller group 32 serves to deliver the sheets P stored in the paper cassette 31, one by one to the transport mechanism 4. The sheet P exemplifies the recording medium in the disclosure.

The transport mechanism 4 includes a roller and a guide member. The transport mechanism 4 extends from the paper feeding device 3 as far as the discharge device 9. The transport mechanism 4 transports the sheets P one by one, from the paper feeding device 3 to the discharge device 9, through the image forming device 6 and the fixing device 8.

The toner supply device 5 supplies toner to the image forming device 6. The toner supply device 5 includes a first mounting base 51Y, a second mounting base 51C, a third mounting base 51M, and a fourth mounting base 51K. The toner supply device 5 is an example of a developing agent supply device. Toner is an example of a developing agent.

On the first mounting base 51Y, a first toner container 52Y is mounted. Likewise, a second toner container 52C is mounted on the second mounting base 51C, a third toner container 52M is mounted on the third mounting base 51M, and a fourth toner container 52K is mounted on the fourth mounting base 51K. The configuration of the first mounting base 51Y to the fourth mounting base 51K is common to all the mounting bases, except for the difference in type of the toner container to be mounted. Accordingly, the first mounting base 51Y to the fourth mounting base 51K may be collectively referred to as "mounting base 51".

The first toner container 52Y, the second toner container 52C, the third toner container 52M, and the fourth toner container 52K are for storing the toner. In this embodiment, yellow toner is stored in the first toner container 52Y. Cyan toner is stored in the second toner container 52C. Magenta toner is stored in the third toner container 52M. Black toner is stored in the fourth toner container 52K.

The image forming device 6 includes an exposure device 61, a first image forming unit 62Y, a second image forming unit 62C, a third image forming unit 62M, and a fourth image forming unit 62K.

The first image forming unit 62Y to the fourth image forming unit 62K each include a charging device 63, a developing device 64, and a photoconductor drum 65. The photoconductor drum 65 exemplifies the image carrier in the disclosure.

The charging device 63 and the developing device 64 are located along the circumferential surface of the photoconductor drum 65. In this embodiment, the photoconductor drum 65 rotates in a direction indicated by an arrow R1 in FIG. 1, namely clockwise.

The charging device 63 discharges electricity, thereby uniformly charging the photoconductor drum 65 to a predetermined polarity. In this embodiment, the charging device 63 charges the photoconductor drum 65 to the positive polarity. The exposure device 61 irradiates the charged photoconductor drum 65 with a laser beam. Accordingly, an electrostatic latent image is formed on the surface of the photoconductor drum 65.

The developing device 64 develops the electrostatic latent image formed on the surface of the photoconductor drum 65, thereby forming a toner image. To the developing device 64, the toner is supplied from the toner supply device 5. The developing device 64 applies the toner supplied from the toner supply device 5 to the surface of the photoconductor drum 65. As result, the toner image is formed on the surface of the photoconductor drum 65.

In this embodiment, the developing device 64 in the first image forming unit 62Y is connected to the first mounting base 51Y. Therefore, the yellow toner is supplied to the developing device 64 in the first image forming unit 62Y. As result, a yellow toner image is formed on the surface of the photoconductor drum 65 in the first image forming unit 62Y.

The developing device 64 in the second image forming unit 62C is connected to the second mounting base 51C. Therefore, the cyan toner is supplied to the developing device 64 in the second image forming unit 62C. As result, a cyan toner image is formed on the surface of the photoconductor drum 65 in the second image forming unit 62C.

The developing device 64 in the third image forming unit 62M is connected to the third mounting base 51M. Therefore, the magenta toner is supplied to the developing device 64 in the third image forming unit 62M. As result, a magenta toner image is formed on the surface of the photoconductor drum 65 in the third image forming unit 62M.

The developing device 64 in the fourth image forming unit 62K is connected to the fourth mounting base 51K. Therefore, the black toner is supplied to the developing device 64 in the fourth image forming unit 62K. As result, a black toner image is formed on the surface of the photoconductor drum 65 in the fourth image forming unit 62K.

The transfer device 7 superposes the toner images formed on the respective photoconductor drums 65 of the first image forming unit 62Y to the fourth image forming unit 62K on the sheet P, thereby transferring the toner images thereto. In this embodiment, the transfer device 7 superposes and transfers the toner images through a secondary transfer process, onto the sheet P. To be more detailed, the transfer device 7 includes four primary transfer rollers 71, an intermediate transfer belt 72, a drive roller 73, a follower roller 74, a secondary transfer roller 75, and a density sensor 76.

The intermediate transfer belt 72 is an endless belt stretched over the four primary transfer rollers 71, the drive roller 73, and the follower roller 74. The intermediate transfer belt 72 is driven by the rotation of the drive roller 73. In FIG. 1, the intermediate transfer belt 72 rotates counterclockwise. The follower roller 74 is made to rotate by the rotation of the intermediate transfer belt 72.

The first image forming unit 62Y to the fourth image forming unit 62K are aligned along the moving direction D of the lower surface of the intermediate transfer belt 72, and each opposed thereto. In this embodiment, the first image forming unit 62Y to the fourth image forming unit 62K are aligned in this order from the upstream side toward the downstream side, along the moving direction D of the lower surface of the intermediate transfer belt 72.

The primary transfer rollers 71 are respectively opposed to, and pressed against, the photoconductor drums 65 via the intermediate transfer belt 72. Accordingly, the toner images formed on the respective photoconductor drums 65 are sequentially transferred to the intermediate transfer belt 72. In this embodiment, the yellow toner image, the cyan toner image, the magenta toner image, and the black toner image are superposed and transferred in this order, to the intermediate transfer belt 72. Hereinafter, the toner image formed by superposing the yellow toner image, the cyan toner image, the magenta toner image, and the black toner image may be referred to as "layered toner image", where appropriate.

The secondary transfer roller 75 is opposed to the drive roller 73, via the intermediate transfer belt 72. The secondary transfer roller 75 is pressed against the drive roller 73. Accordingly, a transfer nip is defined between the secondary transfer roller 75 and the drive roller 73. When the sheet P passes through the transfer nip, the layered toner image on the intermediate transfer belt 72 is transferred to the sheet P. In this embodiment, the yellow toner image, the cyan toner image, the magenta toner image, and the black toner image are transferred to the sheet P, such that the toner images are layered in the mentioned order, from the upper layer to the lower layer. The sheet P to which the layered toner image has been transferred is transported toward the fixing device 8, by the transport mechanism 4.

The density sensor 76 is opposed to the intermediate transfer belt 72, at a position downstream of the first image forming unit 62Y to the fourth image forming unit 62K. The density sensor 76 measures the density of the layered toner image formed on the intermediate transfer belt 72. Here, the density sensor 76 may measure the density of the layered toner image on the photoconductor drum 65, or the density of the toner image fixed to the sheet P.

The fixing device 8 includes a heater 81 and a presser 82. The heater 81 and the presser 82 are opposed to each other, so as to define a fixing nip. The sheet P transported from the image forming device 6 is heated at a predetermined temperature and pressed, while passing through the fixing nip. As result, the layered toner image is fixed to the sheet P. The sheet P is transported by the transport mechanism 4, from the fixing device 8 toward the discharge device 9.

The discharge device 9 includes a discharge roller pair 91 and an output tray 93. The discharge roller pair 91 transports the sheet P toward the output tray 93, through the discharge port 92. The discharge port 92 is located at an upper position of the image forming apparatus 1.

The control device 10 controls the operation of the components provided in the image forming apparatus 1. The control device 10 includes a processor 11 and a storage device 12. The processor 11 includes, for example, a central processing unit (CPU). The storage device 12 includes a memory such as a semiconductor memory, and may also include a hard disk drive (HDD). The storage device 12 contains a control program. The processor 11 controls the operation of the image forming apparatus 1, by executing the control program.

Figure 2:
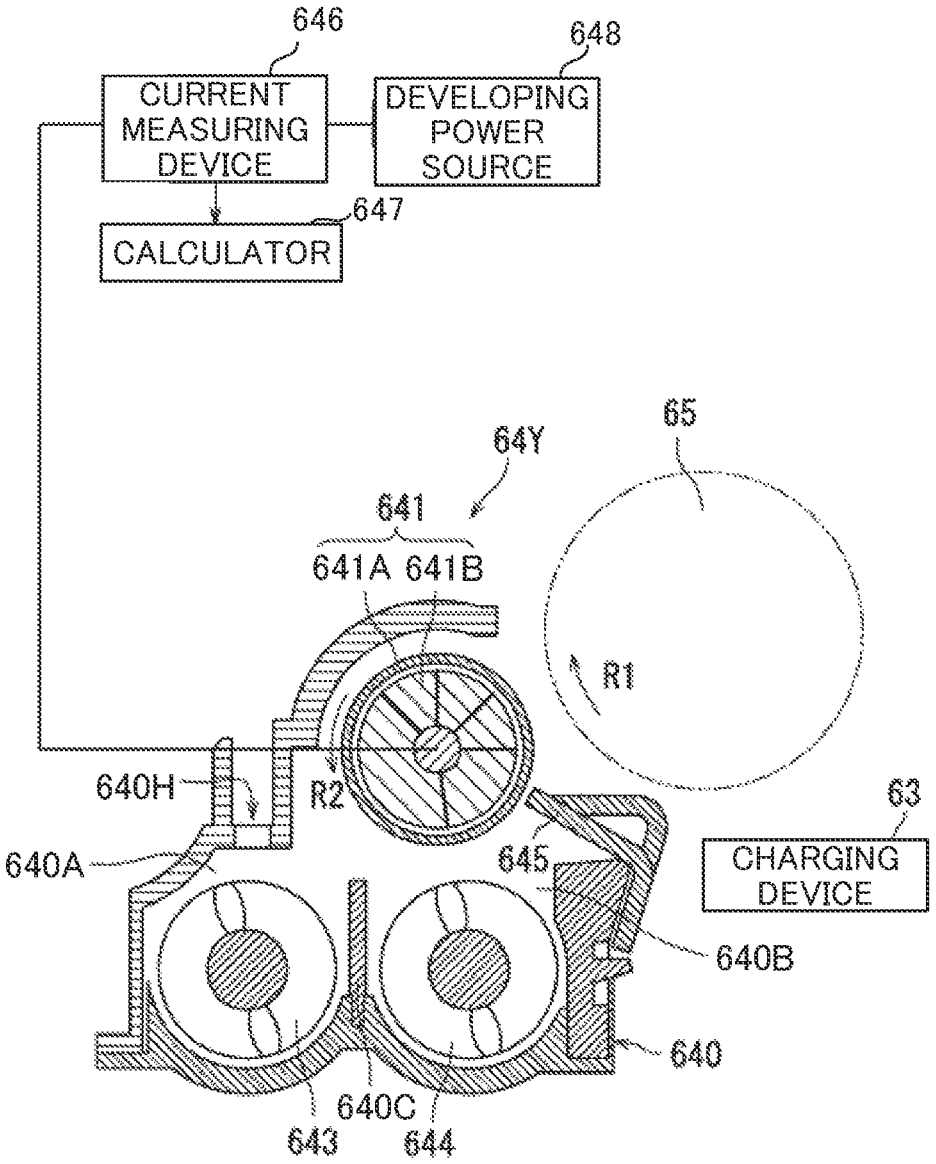
FIG. 2 is a schematic cross-sectional view showing a configuration of a developing device.

Referring to FIG. 2, a configuration of the developing device 64 will be described hereunder. FIG. 2 illustrates an example of the configuration of the developing device 64. More specifically, FIG. 2 illustrates the first developing device 64Y in the first image forming unit 62Y. For the sake of clarity, the photoconductor drum 65 is indicated by dash-dot-dot lines in FIG. 2. In this embodiment, the first developing device 64Y develops the electrostatic latent image formed on the surface of the photoconductor drum 65, through a dual-component developing process. As described above with reference to FIG. 1, the developing container 640 of the first developing device 64Y is connected to the first toner container 52Y. Therefore, the yellow toner is supplied to the developing container 640 of the first developing device 64Y, through a toner inlet 640H.

As shown in FIG. 2, the first developing device 64Y includes a developing roller 641, a first stirring screw 643, a second stirring screw 644, and a blade 645, located inside the developing container 640. To be more detailed, the developing roller 641 is opposed to the second stirring screw 644. The blade 645 is opposed to the developing roller 641.

The developing container 640 is divided into a first mixing chamber 640A and a second mixing chamber 640B, by a partition wall 640C. The partition wall 640C extends in the axial direction of the developing roller 641. The first mixing chamber 640A and the second mixing chamber 640B communicate with each other, on the outer side of the respective ends of the partition wall 640C in the longitudinal direction.

The first stirring screw 643 is provided in the first mixing chamber 640A. In addition, a magnetic carrier is stored in the first mixing chamber 640A. To the first mixing chamber 640A, a non-magnetic toner is supplied through the toner inlet 640H. In the example shown in FIG. 2, the yellow toner is supplied to the first mixing chamber 640A.

The second stirring screw 644 is provided in the second mixing chamber 640B. In addition, a magnetic carrier is stored in the second mixing chamber 640B.

The yellow toner is stirred by the first stirring screw 643 and the second stirring screw 644, thus to be mixed with the carrier. As result, a dual-component developing agent, composed of the carrier and the yellow toner, is formed. Since the dual-component developing agent is an example of the developing agent, the dual-component developing agent may hereinafter be simply referred to as "developing agent", where appropriate.

The first stirring screw 643 and the second stirring screw 644 stir the developing agent, while circulating the developing agent between the first mixing chamber 640A and the second mixing chamber 640B. As result, the toner is charged to a predetermined polarity. In this embodiment, the toner is charged to the positive polarity.

The developing roller 641 is composed of a non-magnetic rotary sleeve 641A and a magnetic body 641B. The magnetic body 641B is fixed inside the rotary sleeve 641A. The magnetic body 641B includes a plurality of magnetic poles. The developing agent adsorbs to the developing roller 641, because of the magnetic force of the magnetic body 641B. As result, a magnetic brush is formed on the surface of the developing roller 641.

In this embodiment, the developing roller 641 rotates in the direction indicated by an arrow R2 in FIG. 2, namely counterclockwise. The developing roller 641 transports, by rotating, the magnetic brush to the position opposite the blade 645. The blade 645 is located so as to define a gap between itself and the developing roller 641. Accordingly, the thickness of the magnetic brush is defined by the blade 645. The blade 645 is located on the upstream side in the rotating direction of the developing roller 641, with respect to the position where the developing roller 641 and the photoconductor drum 65 are opposed to each other.

A predetermined voltage is applied to the developing roller 641. Accordingly, the developing agent layer formed on the surface is transported to the position opposite the photoconductor drum 65, and the toner in the developing agent is adhered to the photoconductor drum 65.

More specifically, the first developing device 64Y further includes a current measuring device 646 and a developing power source 648. Further, the processor 11 acts as a calculator 647, by executing the control program.

The current measuring device 646 is, for example, connected between the developing power source 648 and the developing roller 641. The developing power source 648 applies a predetermined bias voltage, to the developing roller 641 of the first developing device 64Y. The current measuring device 646 detects a current flowing between the photoconductor drum 65 and the developing roller 641, according to the bias voltage applied by the developing power source 648. The current measuring device 646 includes, for example, an ammeter, to measure the current value of the developing current.

Figure 3A:
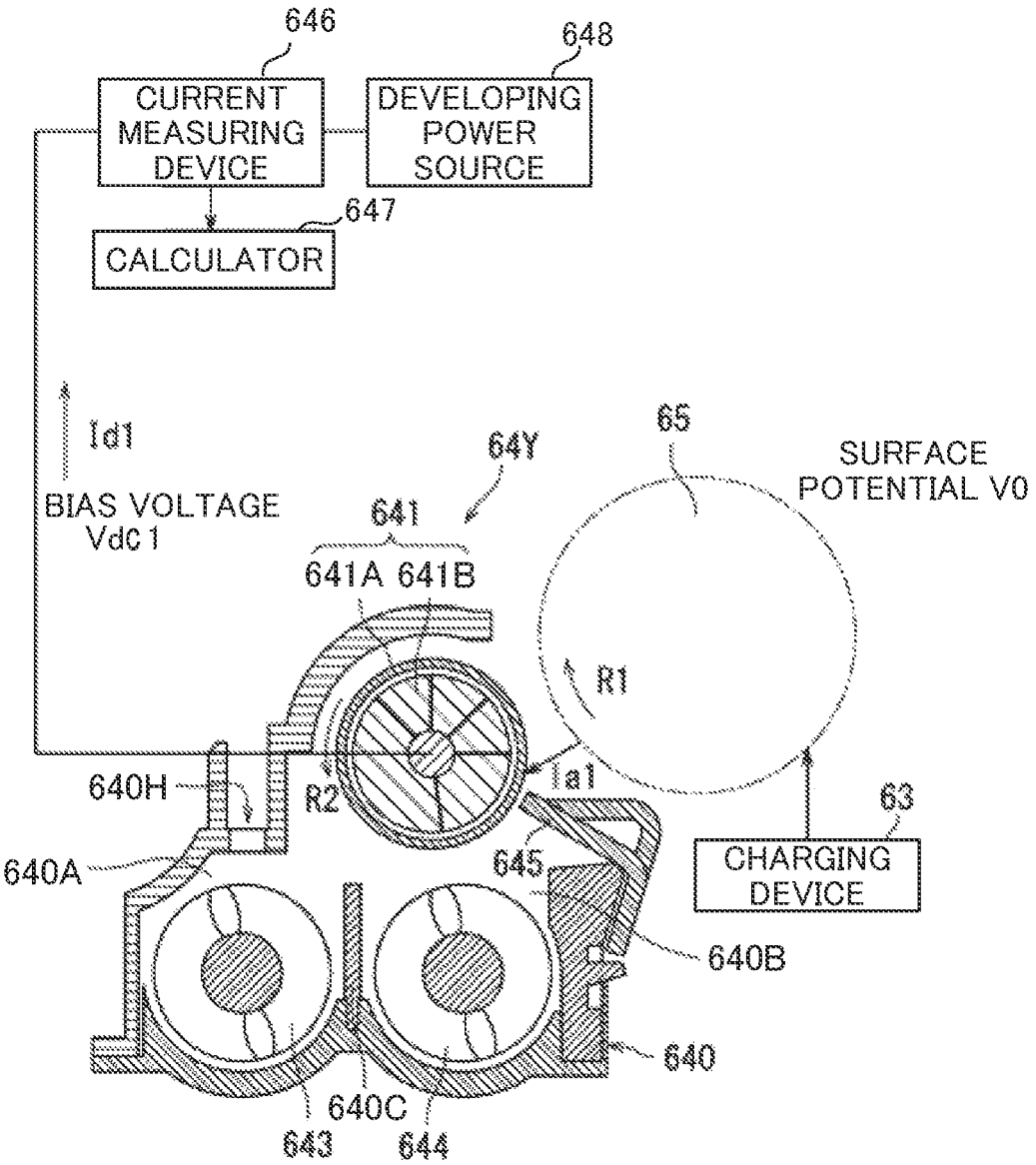
FIG. 3A and FIG. 3B are schematic cross-sectional views for explaining developing current measured by a current measuring device.
Figure 3B:
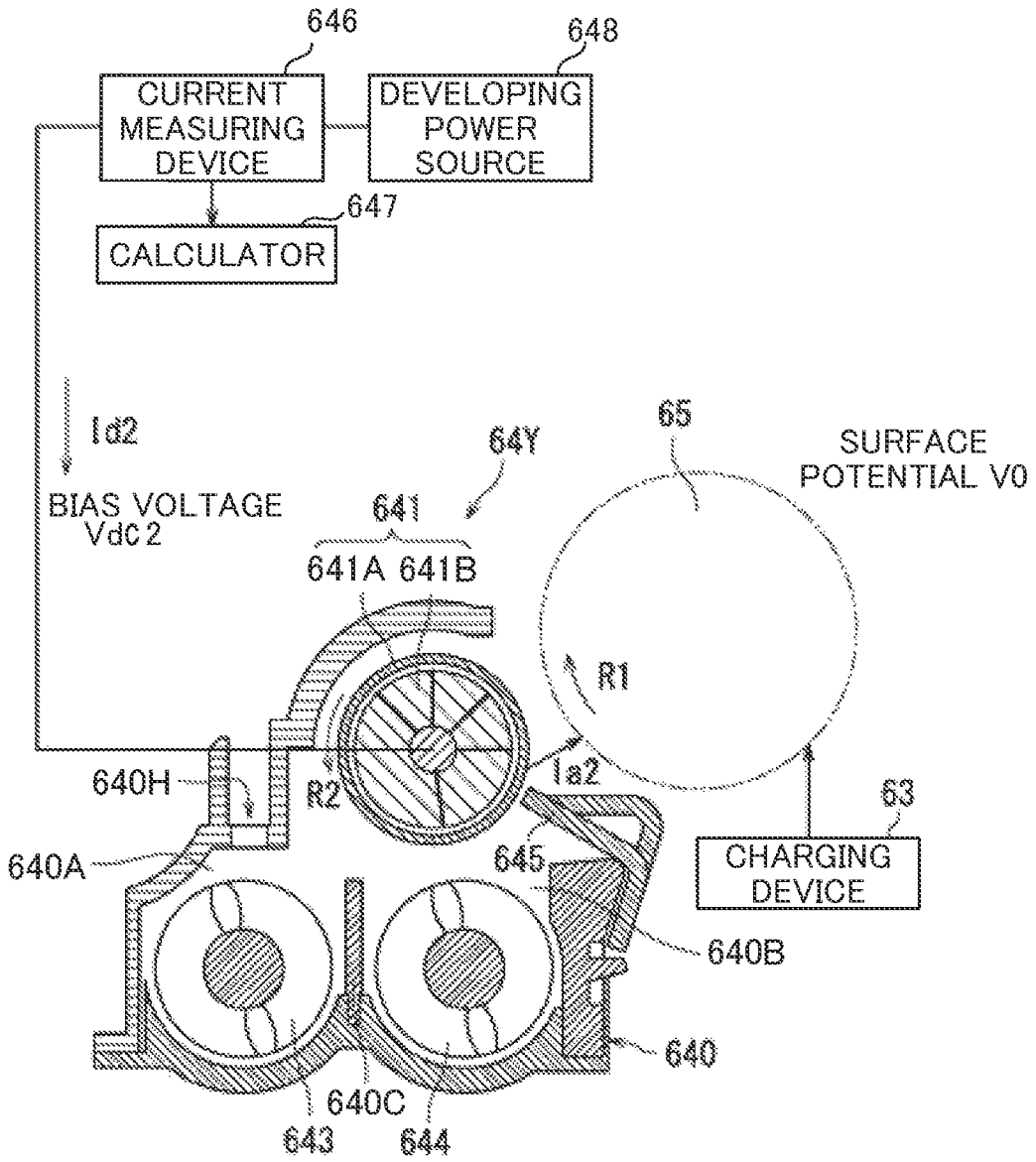

Referring now to FIG. 3A and FIG. 3B, the developing current flowing in the first developing device 64Y will be described hereunder. FIG. 3A and FIG. 3B are schematic cross-sectional views for explaining the developing current measured by the current measuring device 646.

For example, the current measuring device 646 measures the current value of the developing current, flowing while the first developing device 64Y is developing the electrostatic latent image formed on the photoconductor drum 65.

In this embodiment, when the instruction to execute the image forming operation is inputted by the user to the image forming apparatus 1, the control device 10 controls the image forming device 6 so as to cause the components of the image forming device 6 start the image forming operation. More specifically, the control device 10 controls the charging device 63, the first developing device 64Y, the developing power source 648, and the exposure device 61.

The charging device 63 charges, under the control by the control device 10, the surface of the photoconductor drum 65 to a predetermined charge potential (surface potential V0). To be more detailed, when the charging device 63 applies a charging bias to the photoconductor drum 65, the surface of the photoconductor drum 65 is charged to the surface potential V0.

The developing power source 648 applies a bias voltage to the developing roller 641, under the control by the control device 10. The bias voltage contains a DC component and an AC component. FIG. 3A represents the case where a bias voltage, in which the DC component (Vdc1) is smaller than the surface potential V0, is applied to the developing roller 641. Here, it is not mandatory that the bias voltage contains an AC component.

The exposure device 61 irradiates, under the control by the control device 10, the photoconductor drum 65 charged by the charging device 63 to the surface potential V0, with a laser beam. As result, the electrostatic latent image is formed on the surface of the photoconductor drum 65.

When the electrostatic latent image is formed on the surface of the photoconductor drum 65, the first developing device 64Y develops the electrostatic latent image formed on the surface of the photoconductor drum 65, under the control by the control device 10.

At this point, the current measuring device 646 measures the current value of the developing current. Referring to FIG. 3A, the developing current Id1 is the sum of a current flowing when the toner in the magnetic brush formed on the developing roller 641 migrates to the photoconductor drum 65, and a current Ia1 flowing from the photoconductor drum 65 through the magnetic brush formed on the developing roller 641.

FIG. 3B represents the case where a bias voltage, in which the DC component (Vdc2) is larger than the surface potential V0, is applied to the developing roller 641. Referring to FIG. 3B, the developing current Id2 is the sum of a current Ia2 flowing when the toner is developed on the photoconductor drum 65, and a current flowing to the photoconductor drum 65 through the magnetic brush formed on the developing roller 641.

As described above, the developing current measured by the current measuring device 646 is flows in opposite directions, between the cases where the DC component of the bias voltage is larger than the surface potential V0, and where the DC component of the bias voltage is smaller than the surface potential V0.

In addition, when the DC component of the bias voltage is equal to the surface potential V0, the developing electric field intensity becomes zero, and the developing current is measured as zero. Therefore, it can be predicted that the DC component of the bias voltage that makes the developing current zero corresponds to the surface potential V0.

Figure 4:
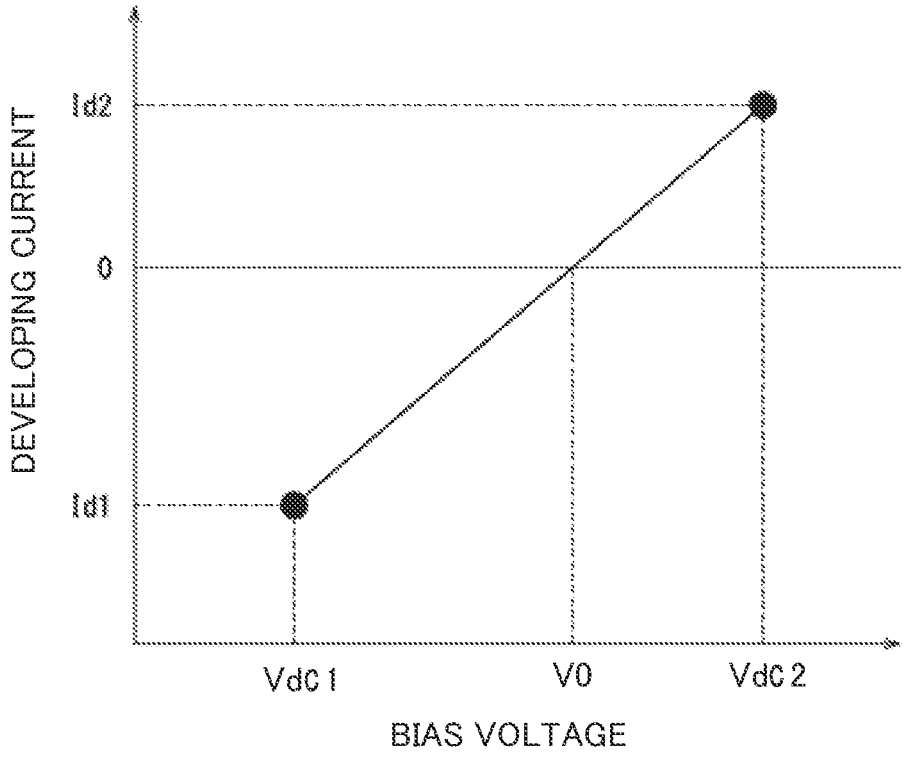
FIG. 4 is a graph showing a relation between the developing current and a bias voltage.

Hereunder, a surface potential calculation method will be described, with reference to FIG. 3A, FIG. 3B, and FIG. 4. FIG. 4 is a graph showing a relation between the developing current and the bias voltage. In FIG. 4, the vertical axis represents the developing current, and the horizontal axis represents the bias voltage.

For example, when the developing power source 648 applies the bias voltage Vdc1 to the developing roller 641, the current measuring device 646 measures the current value of the developing current Id1. The calculator 647 acquires the bias voltage Vdc1 applied by the developing power source 648, and the current value of the developing current Id1 measured by the current measuring device 646 (FIG. 3A).

When the developing power source 648 applies the bias voltage Vdc2 to the developing roller 641, the current measuring device 646 measures the current value of the developing current Id2. The calculator 647 acquires the bias voltage Vdc2 applied by the developing power source 648, and the current value of the developing current Id2 measured by the current measuring device 646 (FIG. 3B).

The calculator 647 calculates the bias voltage that cancels the flow of the developing current, as the surface potential V0, on the basis of the bias voltage Vdc1 and the developing current Id1, and the bias voltage Vdc2 and the developing current Id2, acquired as above.

In this embodiment, the developing devices 64 respectively included in the first image forming unit 62Y to the fourth image forming unit 62K have generally the same configurations, except for the difference in type of the toner supplied from the toner supply device 5. Accordingly, the description about the second developing device 64C to the fourth developing device 64K, respectively included in the second image forming unit 62C to the fourth image forming unit 62K, will be skipped.

For example, the control device 10 determines the bias voltage Vdc to be applied by the developing power source 648 to the developing roller 641, according to the surface potential V0 calculated by the calculator 647.

With the mentioned arrangement, a bias voltage having an appropriate potential difference can be applied to the developing roller 641, in the developing process of the electrostatic latent image, and therefore an image of a higher quality can be obtained.

The calculation of the surface potential is performed, for example, after the instruction to execute the image forming operation is inputted by the user to the image forming apparatus 1, and before the control device 10 controls the image forming device 6 so as to start the image forming operation.

To calculate the surface potential, however, the bias voltages of a plurality of levels have to be applied to the developing roller 641, which is time-consuming.

In addition, when a multitude of pages of images are to be formed, the variation in surface potential during the image forming process is unable to be identified.

As possible measures to the above, for example, the developing current may be measured in a period between the image formation on a sheet and the image forming on the next sheet P, in the image forming device 6, and the surface potential may be calculated. Alternatively, a blank region on the sheet P may be utilized, to measure the developing current and calculate the surface potential.

For example, the surface potential varies depending on the coverage rate of the image to be formed, and therefore calculating the surface potential with respect to each of the sheets P may provide uneven calculation results, which leads to reduced accuracy.

However, calculating the surface potential with respect to a plurality of sheets P as one group may reduce the unevenness of the calculation result. For example, the developing current may be measured a plurality of times under the same condition, in one printing job including forming the image on a plurality of sheets P, and the average of the developing current may be adopted for the calculation of the surface potential.

Figure 5:
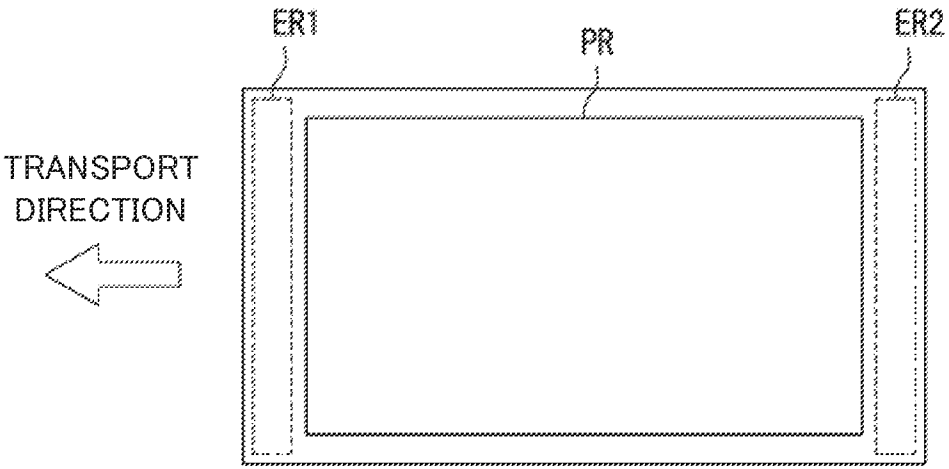
FIG. 5 is a schematic drawing showing an example of an image formed on a sheet.
Figure 6:
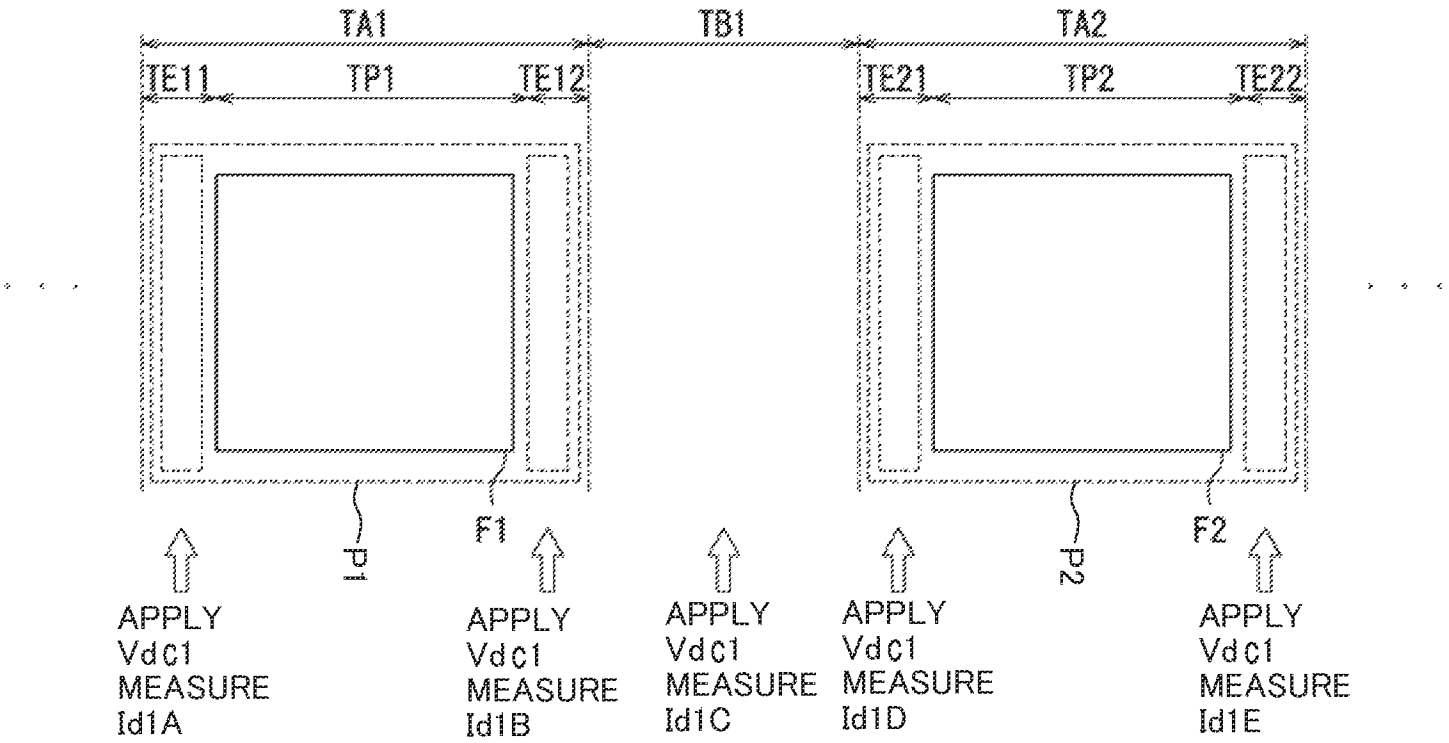
FIG. 6 is a schematic drawing showing how a toner image is formed on the sheet.

Referring now to FIG. 1, FIG. 5, and FIG. 6, a method of measuring the developing current utilizing the blank region will be described hereunder. FIG. 5 illustrates an image formed on the sheet P.

When the sheet P, transported by the transport mechanism 4 in an orientation shown in FIG. 5, passes through the transfer nip between the secondary transfer roller 75 and the drive roller 73, the toner image is transferred to a printing region PR on the sheet P, and thus the image is formed thereon. In this process, blank regions without any image are formed, ahead of and behind the printing region PR. The blank regions include, for example, a leading end blank region ER1 and a trailing end blank region ER2.

Now, the toner image to be transferred to the printing region PR is formed when the electrostatic latent image formed on the rotating photoconductor drum 65 is developed by the developing device 64. The electrostatic latent image is formed when the exposure device 61 continuously irradiates the photoconductor drum 65 with the laser beam, along the axial direction of the photoconductor drum 65.

The blank region is where no image is formed, in the direction orthogonal to the transport direction (i.e., axial direction of photoconductor drum 65). More specifically, the blank region corresponds to the region on the photoconductor drum 65 not irradiated with the laser beam from the exposure device 61, and in which no electrostatic latent image is formed.

FIG. 6 is a schematic drawing showing how the toner image is formed on the sheet P. The toner image is formed through the developing operation by the developing device 64, from the electrostatic latent image.

In this embodiment, when the instruction to execute the job of forming images on a plurality of sheets P is inputted by the user in the image forming apparatus 1, the developing device 64 sequentially forms a toner image F1 corresponding to an image to be formed on the printing region PR of one sheet P1, and a toner image F2 corresponding to an image to be formed on the printing region PR of the next sheet P2.

More specifically, the developing device 64 forms the toner image F1, in a period TA1. The developing device 64 then forms the toner image F2 in a period TA2 which follows a period in which no toner image is formed, namely a period between recording media TB1, corresponding to a period between two sheets P (sheet P1 and next sheet P2) transported by the transport mechanism 4.

To be more detailed, the developing device 64 forms the toner image F1, in a printing period TP1 included in the period TA1. Accordingly, the periods in the period TA1 before and after the printing period TP1 respectively correspond to a first blank forming period in which the leading end blank region ER1 is formed (blank forming period TE11), and a second blank forming period in which the trailing end blank region ER2 is formed (blank forming period TE12).

After the blank forming period TE12 is finished, and also the period between recording media TB1 has elapsed, the developing device 64 forms the toner image F2, in a printing period TP2 included in the next period TA2. In the period TA2, the periods before and after the printing period TP2 respectively correspond to a first blank forming period (blank forming period TE21), and a second blank forming period (blank forming period TE22).

In this embodiment, the current measuring device 646 measures the developing current in the blank forming periods, namely in each of the blank forming periods TE11, TE12, TE21, and TE22.

More specifically, the developing power source 648 applies the bias voltage Vdc1 to the developing roller 641, in each of the blank forming periods. The control device 10 determines the magnitude of the bias voltage Vdc1, for example with respect to each job. The magnitude of the bias voltage Vdc1 may be the same as a preset voltage of the bias voltage to be applied to the developing roller 641 when forming the toner image F1 (e.g., 500V), or different therefrom (e.g., 300V).

Then the current measuring device 646 measures the developing current in each of the blank forming periods. More specifically, the current measuring device 646 measures the current value of the developing current Id1A, in the blank forming period TE11. The current measuring device 646 measures the current value of a developing current Id1B, in the blank forming period TE12. The current measuring device 646 measures the current value of a developing current Id1D, in the blank forming period TE21. The current measuring device 646 measures the current value of a developing current Id1E, in the blank forming period TE22.

The current measuring device 646 also measures the developing current in the period between recording media TB1. To be more detailed, the developing power source 648 applies the bias voltage Vdc1 to the developing roller 641, also in the period between recording media TB1. At this point, the current measuring device 646 measures the current value of a developing current Id1C, in the period between recording media TB1.

Figure 7:
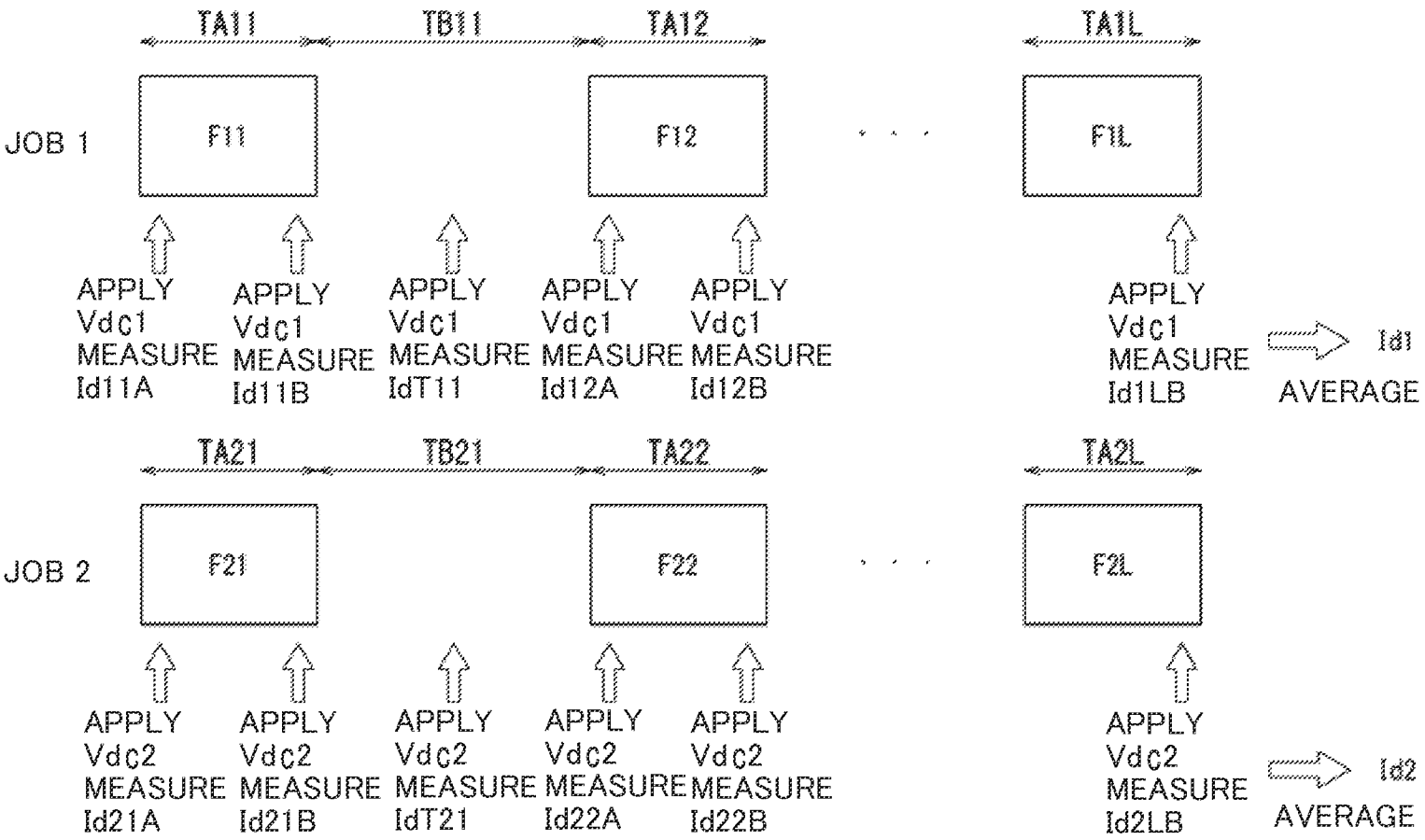
FIG. 7 is a schematic drawing showing the developing current measured with respect to each job.

Referring to FIG. 1 and FIG. 5 to FIG. 7, a surface potential calculation method that utilizes the blank region will be described hereunder. FIG. 7 is a schematic drawing showing the developing current measured with respect to each job.

For example, the developing power source 648 applies the bias voltage Vdc1 to the developing roller 641, in the blank forming periods and the periods between recording media, in a job 1.

Then the current measuring device 646 measures the current value of a developing current Id11A and a developing current Id11B, in the respective blank forming periods included in a period TA11 in which a first toner image F11 of the job 1 is formed.

The current measuring device 646 also measures the current value of a developing current IdT11, in a period between recording media TB11 immediately following the period TA11.

Further, the current measuring device 646 measures the current value of a developing current Id12A and a developing current Id12B, in the respective blank forming periods included in a period TA12 in which a second toner image F12 of the job 1 is formed.

The mentioned measurement of the developing current is repeated with respect to the job 1, until the current measuring device 646 measures the current value of a developing current Id1LB, in the blank forming period included in a period TA1L, in which a last toner image F1L of the job 1 is formed.

The calculator 647 acquires the values of the bias voltage Vdc1 applied by the developing power source 648 in the job 1, and the current value of each of the developing currents Id11A to Id1LB, measured by the current measuring device 646.

calculator 647 calculates the average of the developing currents Id11A to Id1LB acquired, as the value of the developing current Id1 for the job 1, and retains the respective values of the developing current Id1 and the bias voltage Vdc1. For example, the calculator 647 stores the value of the developing current Id1 and the value of the bias voltage Vdc1 in the storage device 12.

Likewise, the developing power source 648 applies a bias voltage Vdc2 to the developing roller 641, in the blank forming periods and the periods between recording media in the job 2.

Then the current measuring device 646 measures the current value of a developing current Id21A and a developing current Id21B, in the respective blank forming periods included in a period TA21 in which a first toner image F21 of the job 2 is formed.

The current measuring device 646 also measures the current value of a developing current IdT21, in a period between recording media TB21 immediately following the period TA21.

Further, the current measuring device 646 measures the current value of a developing current Id22A and a developing current Id22B, in the respective blank forming periods included in a period TA22 in which a second toner image F22 of the job 2 is formed.

The mentioned measurement of the developing current is repeated with respect to the job 2, until the current measuring device 646 measures the current value of a developing current Id2LB, in the blank forming period included in a period TA2L, in which a last toner image F2L of the job 2 is formed.

The calculator 647 acquires the values of the bias voltage Vdc2 applied by the developing power source 648 in the job 2, and the current value of each of the developing currents Id21A to Id2LB, measured by the current measuring device 646.

The calculator 647 calculates the average of the developing currents Id21A to Id2LB acquired, as the value of the developing current Id2 for the job 2, and retains the respective values of the developing current Id2 and the bias voltage Vdc2.

In this embodiment, the calculator 647 calculates the surface potential, on the basis of the value of the bias voltage applied to the developing roller 641 in each job, and the average of the developing currents measured in each job.

More specifically, the calculator 647 calculates, as the surface potential V0, the value of the bias voltage that cancels the flow of the developing current as shown in FIG. 4, on the basis of the value of the bias voltage Vdc1 applied to the developing roller 641 in the job 1, and the average of the developing currents (value of developing current Id1) in the job 1, and also value of the bias voltage Vdc2 applied to the developing roller 641 in the job 2, and the average of the developing currents (value of developing current Id2) in the job 2.

For example, the control device 10 determines the bias voltage to be applied to the developing roller 641 to form the toner image in the next job, according to the surface potential V0 calculated by the calculator 647.

By measuring thus the developing current a plurality of times under the same condition in each job, and taking the average of the developing current, the calculated surface potential is also averaged with respect to each job. Therefore, the calculation result can be prevented from being uneven.

In the first embodiment, the calculator 647 decides that the calculated surface potential V0 is based on an erroneous measurement, for example when the calculated surface potential V0 is different from a predetermined value of the surface potential V0 by an extent equal to or larger than a predetermined threshold. In such a case, the calculator 647 may recalculate the surface potential V0, or adopt the predetermined value of the surface potential V0 as the calculation result.

When there is a Sheet P with High Coverage Rate

In the case where one of the sheets P has a high coverage rate in the first embodiment, the concentration of the toner in the developing container 640 is temporarily lowered, in the period during which the corresponding toner image is formed, which leads to compromise in calculation accuracy of the surface potential.

Accordingly, when there is an image having a coverage rate higher than a predetermined threshold, the calculator 647 excludes the current value of the developing current measured in the period in which the corresponding toner image has been formed, and in the immediately following period between recording media, when calculating the average value.

Figure 8:
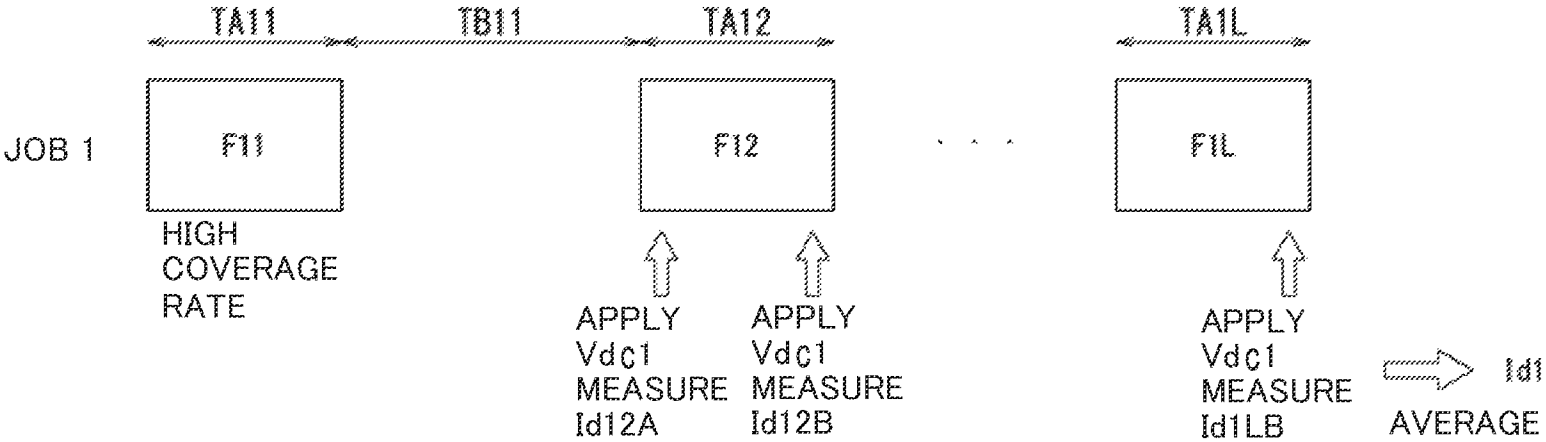
FIG. 8 is a schematic drawing for explaining a method of calculating the average of the developing current, when there is a sheet of a high coverage rate.

Referring to FIG. 8, a method of calculating the average of the developing current, when there is a sheet P of a high coverage rate, will be described hereunder. FIG. 8 is a schematic drawing for explaining the method of calculating the average developing current, when there is a sheet of a high coverage rate. FIG. 8 represents the case where the toner image F11 has a high coverage rate.

When the instruction to execute the job 1 is inputted to the image forming apparatus 1, the control device 10 looks up the image data corresponding to the images to be formed in the job 1, and acquires the coverage rates of the respective images to be formed on a plurality of sheets P. In the case where any of the coverage rates thus acquired is higher than the predetermined threshold, the control device 10 acquires the number of the corresponding image.

In the example shown in FIG. 8, the calculator 647 excludes the current value of the developing current, measured by the current measuring device 646 in the period TA11, in which the toner image F11 corresponding to the image of the acquired number has been formed, and in the period between recording media TB11, from the calculation of the average value.

In other words, the calculator 647 calculates the average value of the developing current (value of developing current Id1) in the job 1, on the basis of the developing currents measured in the period TA12 and the subsequent periods, namely the developing currents Id12A to Id1LB.

Here, although the calculator 647 according to the first embodiment calculates the bias voltage that cancels the flow of the developing current as the surface potential, the calculator 647 may calculate, as the surface potential, a bias voltage corresponding to a developing current, having the same magnitude as the developing current that flows when the surface of the photoconductor drum 65 is not charged.

Other Example of Blank Region

In the first embodiment, the blank regions are not limited to the leading end blank region ER1 and the trailing end blank region ER2 shown in FIG. 5. The blank region may be any region, provided that no image is formed in that region in the direction orthogonal to the transport direction. For example, the blank region may be a portion in the printing region PR including a blank, or a portion in the printing region PR where the ratio of the image to be formed therein, in the direction orthogonal to the transport direction, is lower than a predetermined ratio.

For example, in the case where the control device 10 decides, upon looking up the corresponding image data, that the image representing the image data includes a blank, the control device 10 controls the developing power source 648 and the current measuring device 646, so as to measure the developing current in the period in which the corresponding image including the blank is formed.

Figure 9A:
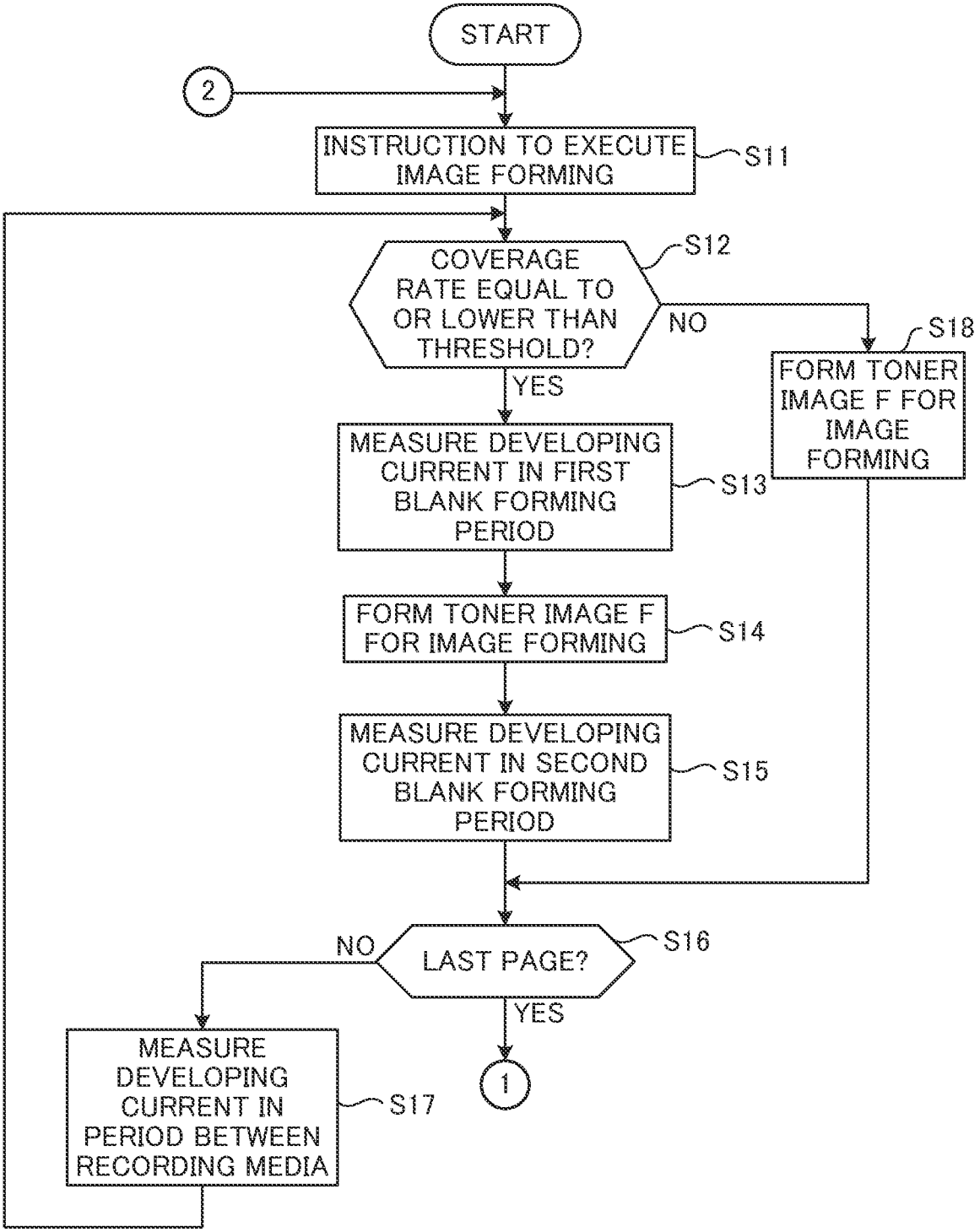
FIG. 9A and FIG. 9B are flowcharts showing a surface potential calculation process according to a first embodiment.
Figure 9B:
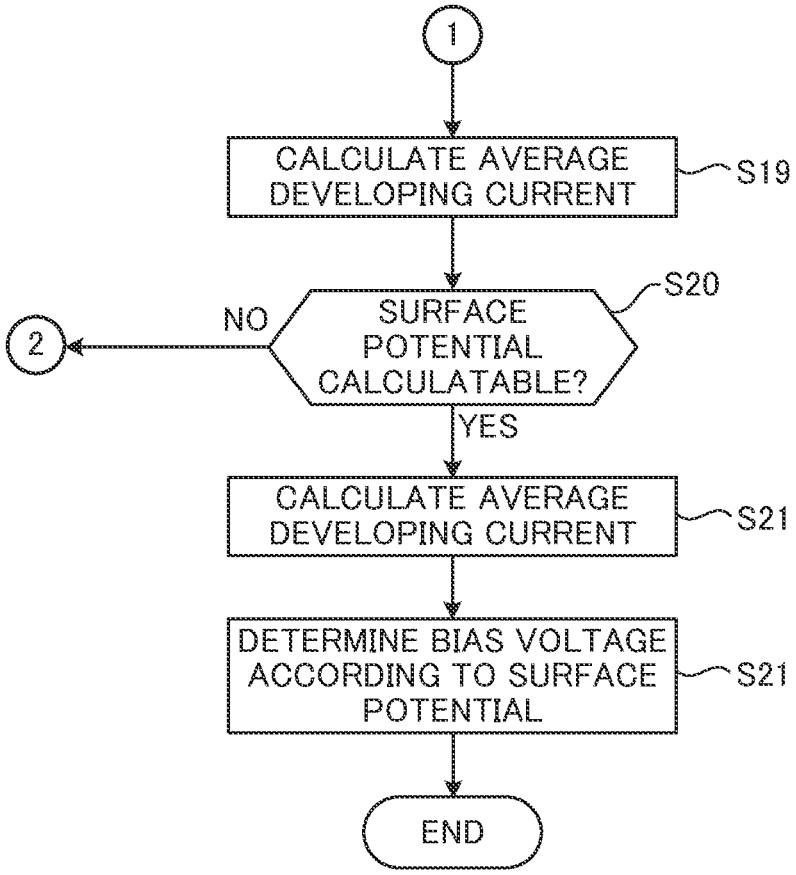

Referring now to FIG. 9A and FIG. 9B, a process of calculating the surface potential according to the first embodiment will be described hereunder. FIG. 9A and FIG. 9B are flowcharts showing the surface potential calculation process according to the first embodiment. FIG. 9B represents the process subsequent to FIG. 9A.

When the instruction to execute a job of forming images on a plurality of sheets (plurality of pages) is inputted by the user in the image forming apparatus 1 (step S11), the control device 10 looks up the corresponding image data, and acquires the coverage rate of the toner image, to be formed on one of the plurality of sheets P (step S12).

When the acquired coverage rate of the toner image is higher than the predetermined threshold (No at step S12), the control device 10 controls the developing device 64 so as to form the toner image (step S18). After step S18, the control device 10 proceeds to step S16.

When the acquired coverage rate of the toner image F is equal to or lower than the predetermined threshold (Yes at step S12), the control device 10 controls the developing power source 648 so as to apply the bias voltage Vdc1 to the developing roller 641 in the first blank forming period, and causes the current measuring device 646 to measure the developing current in the first blank forming period (step S13).

The control device 10 controls the developing device 64 so as to form the toner image F (step S14).

The control device 10 controls the developing power source 648 so as to apply the bias voltage Vdc1 to the developing roller 641 in the second blank forming period, and also causes the current measuring device 646 to measure the developing current in the second blank forming period (step S15).

When the toner image formed by the developing device 64 corresponds to a page other than the last page (No at step S16), the control device 10 controls the developing power source 648 so as to apply the bias voltage Vdc1 to the developing roller 641 in the period between recording media, and also causes the current measuring device 646 to measure the developing current in the period between recording media (step S17). The control device 10 controls the developing device 64 so as to form the image of the next page (step S12).

In contrast, when the toner image formed by the developing device 64 corresponds to the last page (Yes at step S16), the control device 10 finishes the image forming operation. Then the control device 10 proceeds to step S19.

The calculator 647 calculates the average of the developing currents measured by the current measuring device 646, in the first blank forming period, in the second blank forming period, and in the period between recording media (step S19).

In the case where the calculation of the average of the developing currents is already finished in a plurality of jobs, and it is possible to calculate the surface potential (Yes at step S20), the calculator 647 calculates the surface potential (step S21).

The control device 10 determines the bias voltage to be applied to the developing roller 641 when the next toner image is to be formed, according to the surface potential calculated by the calculator 647 (step S22).

In the case where the surface potential is still unable to be calculated (No at step S20), the calculator 647 stands by for the instruction to execute the next job to be inputted in the image forming apparatus 1 (step S11).

In the first embodiment, the control device 10 regards the period in which one of the two blank regions included in a single sheet P is formed, as the first blank forming period, and the period in which the other blank region is formed, as the second blank forming period. However, without limitation to the above, the developing current may be measured and the surface potential may be calculated, with respect to the period in which one of the blank regions included in a plurality of sheets P is formed, as the first blank forming period, and the period in which the other blank region is formed, as the second blank forming period.

In addition, although two blank regions are included in a sheet P in the first embodiment, three or more blank regions, or only one blank region may be included in a sheet P.

First Working Example

Hereunder, the disclosure will be described in detail with reference to a first working example. However, the disclosure is not limited to the first working example.

For the first working example, a multifunction peripheral was employed as the image forming apparatus 1. The multifunction peripheral was a modified model of TASKalfa2550Ci, from Kyosera Document Solutions Inc.

The experiment conditions of the multifunction peripheral were as specified below.

Photoconductor drum 65: amorphous silicon (a-Si) drum
Film thickness of photoconductor drum 65: 20 μm
Charging device 63: Outer diameter of core of charging roller 6 mm, rubber thickness 3 mm, rubber resistance 6.0 Log Ω
Charging bias: DC only
Blade 645: SUS430, Magnetic
Thickness of blade 645: 1.5 mm
Surface of developing roller 641: Knurled and blasted
Outer diameter of developing roller 641: 20 mm
Recess of developing roller 641: Circumferentially 80 rows
Circumferential speed of developing roller 641/circumferential speed of photoconductor drum 65: 1.8
Distance between developing roller 641 and photoconductor drum 65: 0.30 mm
AC component of bias voltage: Vpp 1200V, duty 50%, square wave, 8 kHz
Toner: particle diameter 6.8 μm, positively charged
Carrier: particle diameter 38 μm, resin-coated ferrite carrier
Toner concentration: 6%
Printing speed: 55 sheets/min.

Figure 11:
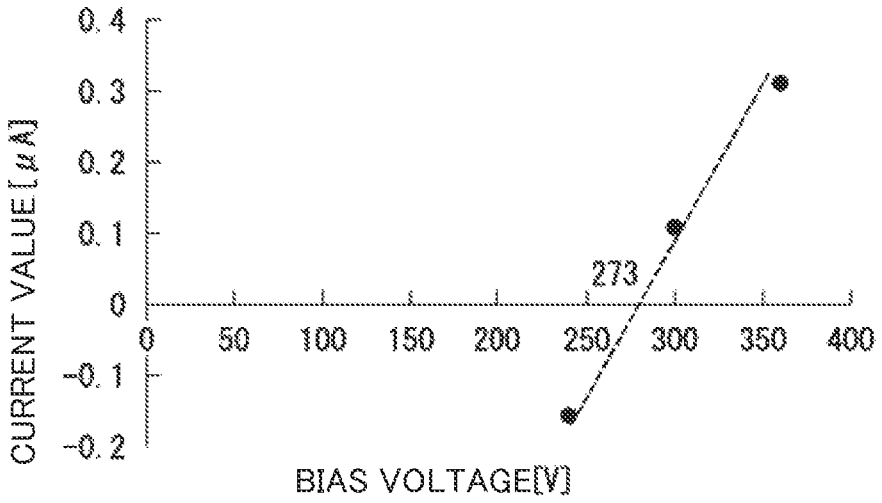
FIG. 11 is a graph showing a relation between the bias voltage and the average developing current, shown in FIG. 10.

Referring to FIG. 10 and FIG. 11, the surface potential calculated by the image forming apparatus 1 according to the first working example will be described hereunder.

FIG. 10 is a table showing the average of the developing currents with respect to each job, measured when three levels of bias voltages are applied to the developing roller 641, during execution of jobs 1 to 3 by the image forming apparatus 1 according to the first working example.

FIG. 11 is a graph showing a relation between the bias voltage and the average developing current, shown in FIG. 10. In FIG. 11, the vertical axis represents the developing current, and the horizontal axis represents the bias voltage.

In the first working example, when the bias voltage of 240[V] was applied in the job 1, the average of the measured developing currents was −0.16 [μA]. When the bias voltage of 300[V] was applied in the job 2, the average of the measured developing currents was 0.11 [μA]. When the bias voltage of 360[V] was applied in the job 3, the average of the measured developing currents was 0.31 [μA].

As shown in FIG. 11, the surface potential was calculated as 273[V], in the image forming apparatus 1 according to the first working example.

Although the difference in bias voltages to be applied was set to 120 V at maximum, in the first working example, the difference may be 100 V at maximum, without limitation to the above. It is preferable, however, that the difference in bias voltages to be applied is approximately 50 V.

In the first working example, the amorphous silicon drum was employed as the photoconductor drum 65. However, without limitation to the above, a positive-charging organic photoconductor drum may be employed. When the amorphous silicon drum is employed as the photoconductor drum 65, the dielectric constant of the photosensitive layer is higher than that of the positive-charging organic photoconductor drum, and therefore the current flow is encouraged and the carrier resistance is reduced, which leads to higher measurement accuracy.

In addition, although the dual-component developing agent is employed in the first working example, a single-component developing agent may be employed, without limitation to the above.

Second Embodiment

Hereafter, a second embodiment of the disclosure will be described, with a focus on differences from the first embodiment.

In the case where, for example, the developing current is measured in a period between the image forming on one sheet P and the image forming on the next sheet P, a sufficient distance and period may be unable to be secured for the measurement (sampling) of the developing current, depending on the transport speed of the sheets P. On the other hand, there are cases where a plurality of blank regions are formed in a single sheet P, or where the blank region is sufficiently wide for the measurement of the developing current. In such cases, a larger number of samplings can be acquired.

Figure 12:
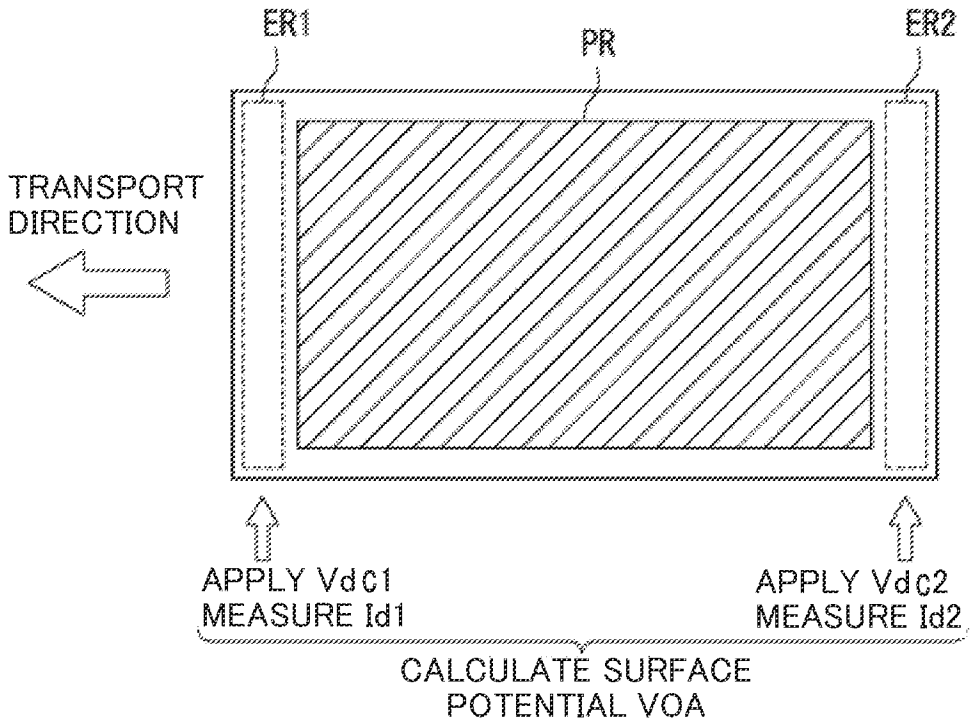
FIG. 12 is a schematic drawing showing another example of an image formed on a sheet.
Figure 13:
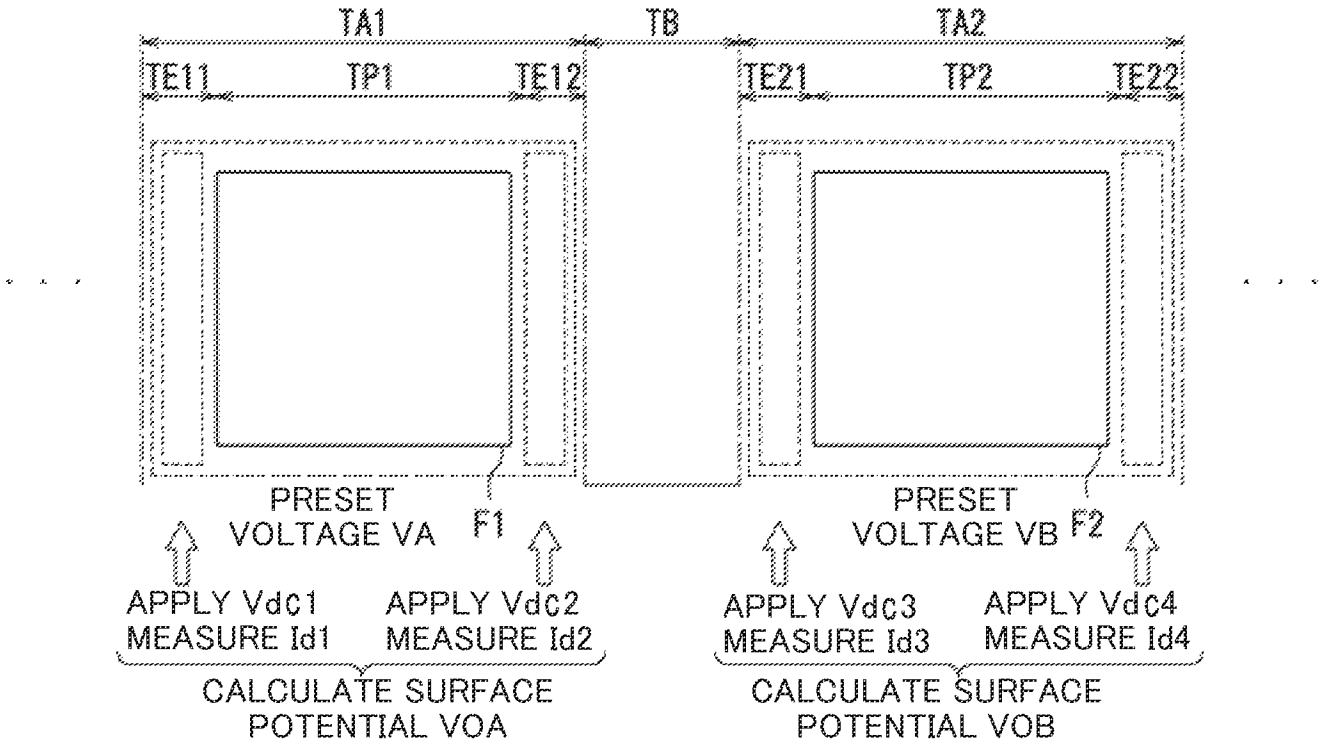
FIG. 13 is a schematic drawing showing another example of how a toner image is formed on the sheet.

Referring to FIG. 1 and FIG. 12 to FIG. 14, a surface potential calculation method that utilizes the blank region will be described hereunder. FIG. 12 is a schematic drawing showing the image formed on the sheet P. FIG. 13 is a schematic drawing showing another example of how the toner image is formed on the sheet P.

Referring to FIG. 12 and FIG. 13, for example, the developing device 64 forms the toner image F1 in the period TA1, and then forms the toner image F2 in the period TA2, after the period between recording media TB has elapsed.

More specifically, the developing device 64 forms the toner image F1 in the printing period TP1 included in the period TA1. Accordingly, the periods in the period TA1 before and after the printing period TP1 are respectively defined as the first blank forming period (blank forming period TE11) in which the leading end blank region ER1 is formed, and the second blank forming period (blank forming period TE12) in which the trailing end blank region ER2 is formed.

The developing device 64 forms the toner image F2 in the printing period TP2 included in the next period TA2, after the blank forming period TE12 is finished and the period TB has elapsed.

In the second embodiment, the current measuring device 646 measures the current value of the developing current, in each of the blank forming periods. For example, the current measuring device 646 measures the current value of the developing current in the blank forming period TE11.

To be more detailed, the developing power source 648 applies the bias voltage Vdc1 to the developing roller 641, in the blank forming period TE11. The value of the bias voltage Vdc1 may be the same as the preset voltage VA (e.g., 500V) of the bias voltage to be applied to the developing roller 641 when forming the toner image F1, or different therefrom (e.g., 300V).

Then the current measuring device 646 measures the current value of the developing current Id1. The calculator 647 acquires the value of the bias voltage Vdc1 applied by the developing power source 648, and the current value of the developing current Id1 measured by the current measuring device 646.

The current measuring device 646 also measures the current value of the developing current in the blank forming period TE12. To be more detailed, the developing power source 648 applies the bias voltage Vdc2 to the developing roller 641, in the blank forming period TE12. Then the current measuring device 646 measures the current value of the developing current Id2. The calculator 647 acquires the value of the bias voltage Vdc2 applied by the developing power source 648, and the current value of the developing current Id2 measured by the current measuring device 646.

The calculator 647 calculates the bias voltage that cancels the flow of the developing current, as the surface potential VOA, on the basis of the bias voltage Vdc1 and the developing current Id1, and the bias voltage Vdc2 and the developing current Id2, acquired as above.

Likewise, the current measuring device 646 measures the current value of the developing current, in the blank forming period TE21 and the blank forming period TE22. The calculator 647 calculates the surface potential, on the basis of the current value of the developing current measured in the blank forming period TE21 and the blank forming period TE22.

In the second embodiment, for example, the control device 10 determines the value VB of the bias voltage to be applied to the developing roller 641 when forming the next toner image F2, according to the surface potential VOA calculated by the calculator 647.

The control device 10 determines the value of the bias voltage Vdc3 to be applied to the developing roller 641 in the blank forming period TE21, and the value of the bias voltage Vdc4 to be applied to the developing roller 641 in the blank forming period TE22, on the basis of the bias voltage VB. The control device 10 determines the bias voltage Vdc3, like the bias voltage Vdc1, to a voltage lower than the assumed surface potential in the period TA2. The control device 10 also determines the bias voltage Vdc4, like the bias voltage Vdc2, to a voltage higher than the assumed surface potential in the period TA2.

For example, the developing power source 648 applies the bias voltage Vdc3 determined as above to the developing roller 641, in the blank forming period TE21. Then the current measuring device 646 measures the current value of the developing current Id3. The calculator 647 acquires the value of the bias voltage Vdc3 applied by the developing power source 648, and the current value of the developing current Id3 measured by the current measuring device 646.

In addition, the developing power source 648 applies the bias voltage Vdc4 determined as above to the developing roller 641, in the blank forming period TE22. Then the current measuring device 646 measures the current value of the developing current Id4. The calculator 647 acquires the value of the bias voltage Vdc4 applied by the developing power source 648, and the current value of the developing current Id4 measured by the current measuring device 646.

The calculator 647 calculates the bias voltage that cancels the flow of the developing current, as the surface potential V0B, on the basis of the bias voltage Vdc3 and the developing current Id3, and the bias voltage Vdc4 and the developing current Id4, acquired as above.

Figure 14:
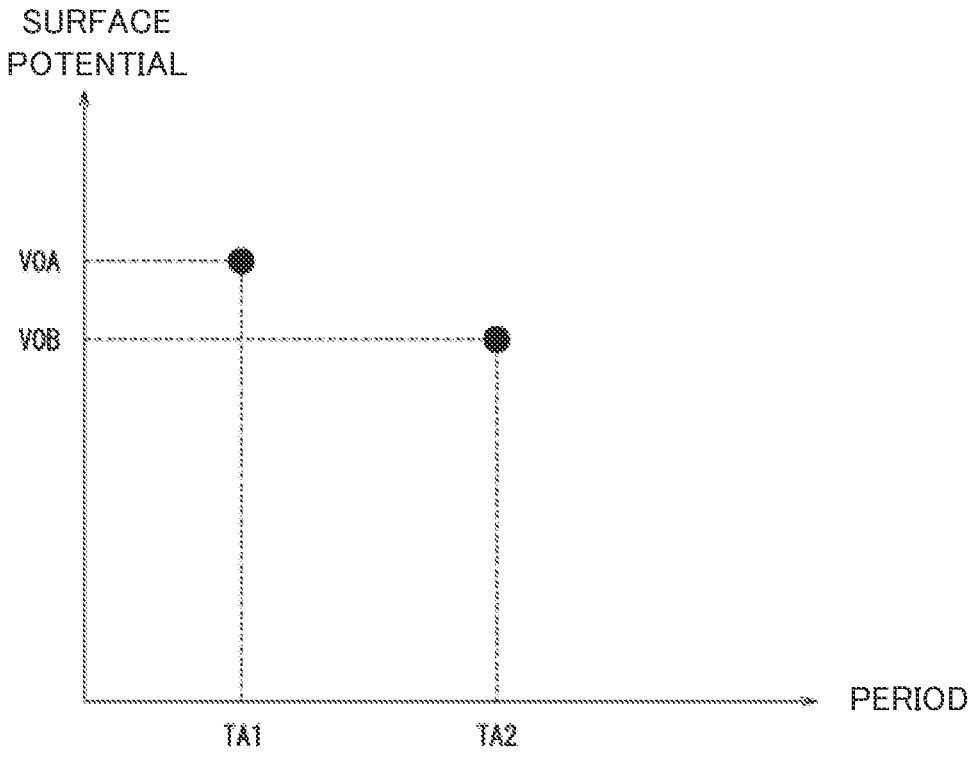
FIG. 14 is a graph showing transition of the surface potential based on the formation process of the toner image.

FIG. 14 is a graph showing transition of the surface potential based on the formation process of the toner image. In FIG. 14, the vertical axis represents the surface potential, and the horizontal axis represents the period in which the surface potential has been calculated.

As shown in FIG. 14, calculating the surface potential in each period in which the toner image is formed enables the transition of the surface potential that takes place while the images are formed on a plurality of sheets P to be recognized, thereby facilitating prediction of the deterioration of the charging device 63 and the photoconductor drum 65.

In the second embodiment, the calculator 647 decides that the calculated surface potential V0B is based on an erroneous measurement, for example when the calculated surface potential V0B is different from the surface potential VOA by an extent equal to or larger than a predetermined threshold. In such a case, the calculator 647 may recalculate the surface potential, or adopt the surface potential VOA as the calculation result.

In the second embodiment, the control device 10 determines the bias voltage to be applied to the developing roller 641 when forming the next toner image in the same job, according to the surface potential calculated by the calculator 647. However, without limitation to the above, the control device 10 may determine the bias voltage to be applied to the developing roller 641 when forming the next and subsequent toner images in the same job, or determine the bias voltage to be applied to the developing roller 641 when forming the toner image in the next and subsequent jobs.

When there is a Sheet P with High Coverage Rate

In the case where one of the sheets P has a high coverage rate in the second embodiment, the concentration of the toner in the developing container 640 is temporarily lowered, in the period during which the corresponding toner image is formed, which leads to compromise in calculation accuracy of the surface potential.

Accordingly, when there is an image having a coverage rate higher than a predetermined threshold, the calculator 647 does not calculate the surface potential, in the period including the printing period in which the toner image corresponding to the mentioned image is printed.

Figure 15:
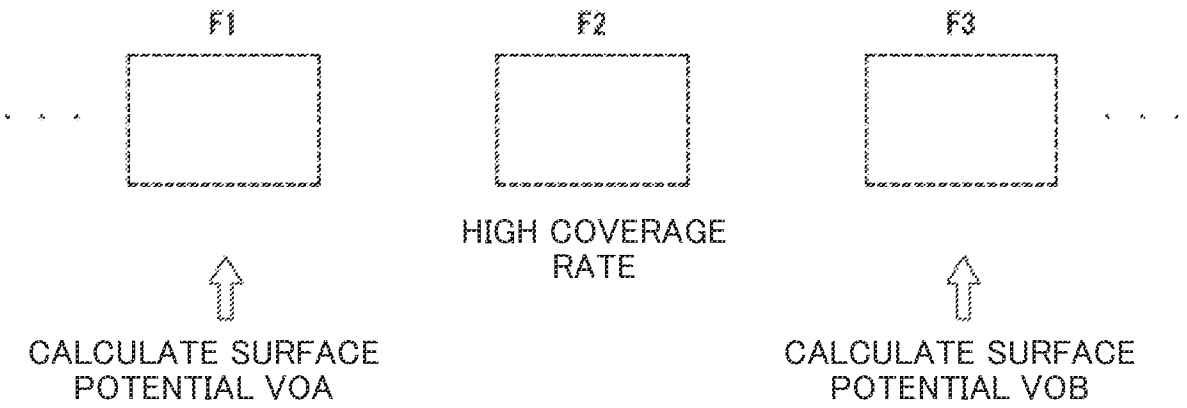
FIG. 15 is a schematic drawing for explaining another method of calculating the surface potential, when there is a sheet of a high coverage rate.

Referring to FIG. 15, a method of calculating the surface potential, when there is a sheet P of a high coverage rate, will be described hereunder. FIG. 15 is a schematic drawing for explaining the method of calculating the surface potential, when there is a sheet of a high coverage rate. FIG. 15 represents the case where the toner image F2 has a high coverage rate.

When the instruction to execute the image forming on a plurality of sheets is inputted to the image forming apparatus 1, the control device 10 looks up the image data corresponding to the images to be formed, and acquires the coverage rates of the respective images to be formed on a plurality of sheets P. In the case where any of the coverage rates thus acquired is higher than the predetermined threshold, the control device 10 acquires the number of the corresponding image.

In the example shown in FIG. 15, the calculator 647 does not calculate the surface potential, in the period in which the toner image F2, corresponding to the image of the acquired number, is formed.

Other Example of Blank Region

In the second embodiment, the blank regions are not limited to the leading end blank region ER1 and the trailing end blank region ER2 shown in FIG. 12. The blank region may be any region, provided that no image is formed in that region in the direction orthogonal to the transport direction. For example, the blank region may be a portion in the printing region PR including a blank.

Figure 16:
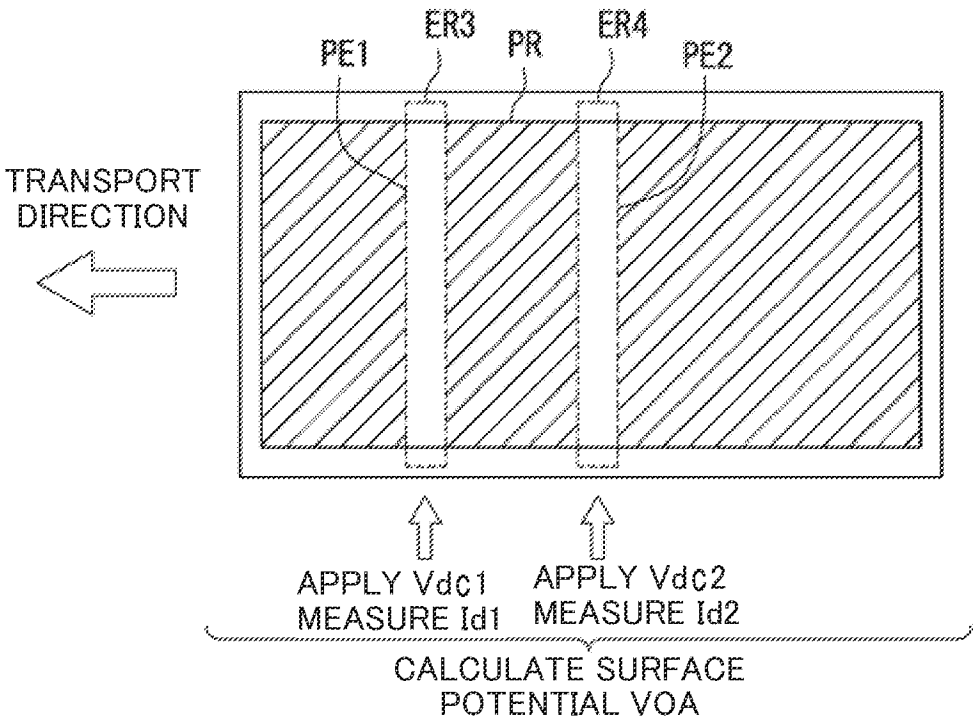
FIG. 16 is a schematic drawing showing another example of a blank region.

Hereunder, another example of the blank region will be described, with reference to FIG. 16. FIG. 16 illustrates another example of the blank region.

The printing region PR in the sheet P shown in FIG. 16 includes blanks PE1 and PE2. In such a case, the regions including the blanks PE1 and PE2 are respectively defined as the blank regions (blank regions ER3 and ER4).

For example, the control device 10 looks up the corresponding image data, and controls, when the image data represents the image including the blanks PE1 and PE2, the developing power source 648 and the current measuring device 646 so as to measure the developing current, in the periods in which the blank regions ER3 and ER4 are respectively formed.

More specifically, the control device 10 controls the developing power source 648 and the current measuring device 646 so as to measure the developing current, regarding the period in which the blank region ER3 is formed, as the first blank forming period. Likewise, the control device 10 controls the developing power source 648 and the current measuring device 646 so as to measure the developing current, regarding the period in which the blank region ERA is formed, as the second blank forming period.

The developing power source 648 applies the bias voltage Vdc1 to the developing roller 641 in the first blank forming period, under the control by the control device 10. Then the current measuring device 646 measures the current value of the developing current Id1. The calculator 647 acquires the value of the bias voltage Vdc1 applied by the developing power source 648, and the current value of the developing current Id1 measured by the current measuring device 646.

Likewise, the developing power source 648 applies the bias voltage Vdc2 to the developing roller 641 in the second blank forming period, under the control by the control device 10. Then the current measuring device 646 measures the current value of the developing current Id2. The calculator 647 acquires the value of the bias voltage Vdc2 applied by the developing power source 648, and the current value of the developing current Id2 measured by the current measuring device 646.

The calculator 647 calculates the bias voltage that cancels the flow of the developing current, as the surface potential VOA, on the basis of the bias voltage Vdc1 and the developing current Id1, and the bias voltage Vdc2 and the developing current Id2, acquired as above.

Here, the blank region may be a region in the printing region PR in which the ratio of the image formed in the direction orthogonal to the transport direction is lower than a predetermined ratio. In this case, the calculator 647 corrects the current value of the developing current measured by the current measuring device 646, to the value that would be measured in the period in which the blank region ER3 is formed, and utilizes such corrected value for the calculation of the surface potential.

Figure 17:
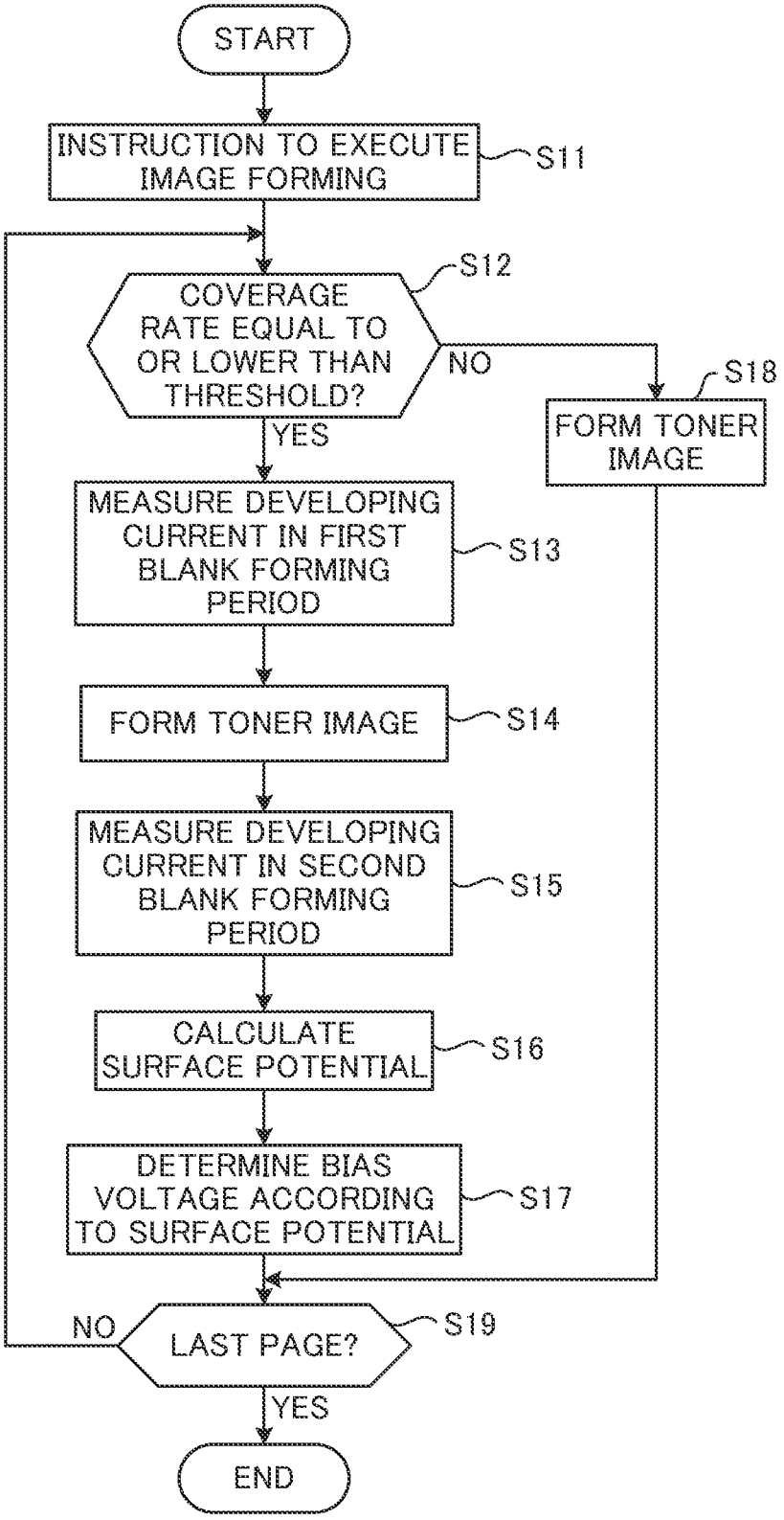
FIG. 17 is a flowchart showing a surface potential calculation process according to a second embodiment.

Referring now to FIG. 17, a process of calculating the surface potential according to the second embodiment will be described hereunder. FIG. 17 is a flowchart showing the surface potential calculation process according to the second embodiment.

When the instruction to execute a job of forming images on a plurality of sheets (plurality of pages) is inputted by the user in the image forming apparatus 1 (step S11), the control device 10 looks up the corresponding image data, and acquires the coverage rate of the toner image, to be formed on one of the plurality of sheets P (step S12).

When the acquired coverage rate of the toner image is higher than the predetermined threshold (No at step S12), the control device 10 controls the developing device 64 so as to form the toner image (step S18). After step S18, the control device 10 proceeds to step S19.

When the acquired coverage rate of the toner image is equal to or lower than the predetermined threshold (Yes at step S12), the control device 10 controls the developing power source 648 so as to apply the bias voltage to the developing roller 641 in the first blank forming period, and causes the current measuring device 646 to measure the developing current in the first blank forming period (step S13).

The control device 10 controls the developing device 64 so as to form the toner image (step S14).

The control device 10 controls the developing power source 648 so as to apply the bias voltage to the developing roller 641 in the second blank forming period, and also causes the current measuring device 646 to measure the developing current in the second blank forming period (step S15).

The calculator 647 calculates the surface potential, on the basis of the developing currents measured by the current measuring device 646, in the first blank forming period and in the second blank forming period (step S16).

The control device 10 determines the bias voltage to be applied to the developing roller 641 when the next toner image is to be formed, according to the surface potential calculated by the calculator 647 (step S17).

When the toner image formed by the developing device 64 corresponds to a page other than the last page (No at step S19), the control device 10 controls the developing device 64 so as to form the image of the next page (step S12).

In contrast, when the toner image formed by the developing device 64 corresponds to the last page (Yes at step S19), the control device 10 finishes the image forming operation.

Although two blank regions are included in a sheet P in the second embodiment, three or more blank regions may be included in a sheet P.

In this case, the control device 10 controls the developing power source 648 and the current measuring device 646 so as to measure the developing current, regarding the period in which at least one of the three blank regions is formed, as the first blank forming period. In addition, the control device 10 controls the developing power source 648 and the current measuring device 646 so as to measure the developing current, regarding the period in which at least one of the remaining blank regions is formed, as the second blank forming period.

In the second embodiment, further, one blank region may be included in one sheet P.

Second Working Example

Hereunder, the disclosure will be described in detail with reference to a second working example. However, the disclosure is not limited to the second working example.

For the second working example, a multifunction peripheral was employed as the image forming apparatus 1. The multifunction peripheral was a modified model of TASKalfa2550Ci, from Kyosera Document Solutions Inc.

The experiment conditions of the multifunction peripheral were as specified below.

Photoconductor drum 65: amorphous silicon (a-Si) drum
Film thickness of photoconductor drum 65: 20 μm
Charging device 63: Outer diameter of core of charging roller 6 mm, rubber thickness 3 mm, rubber resistance 6.0 Log Ω
Charging bias: DC only
Blade 645: SUS430, Magnetic
Thickness of blade 645: 1.5 mm
Surface of developing roller 641: Knurled and blasted
Outer diameter of developing roller 641: 20 mm
Recess of developing roller 641: Circumferentially 80 rows
Circumferential speed of developing roller 641/circumferential speed of photoconductor drum 65: 1.8
Distance between developing roller 641 and photoconductor drum 65: 0.30 mm AC component of bias voltage: Vpp 1200V, duty 50%, square wave, 8 kHz Toner: particle diameter 6.8 μm, positively charged Carrier: particle diameter 38 μm, resin-coated ferrite carrier Toner concentration: 6%

Printing speed: 55 sheets/min.

Figure 19:
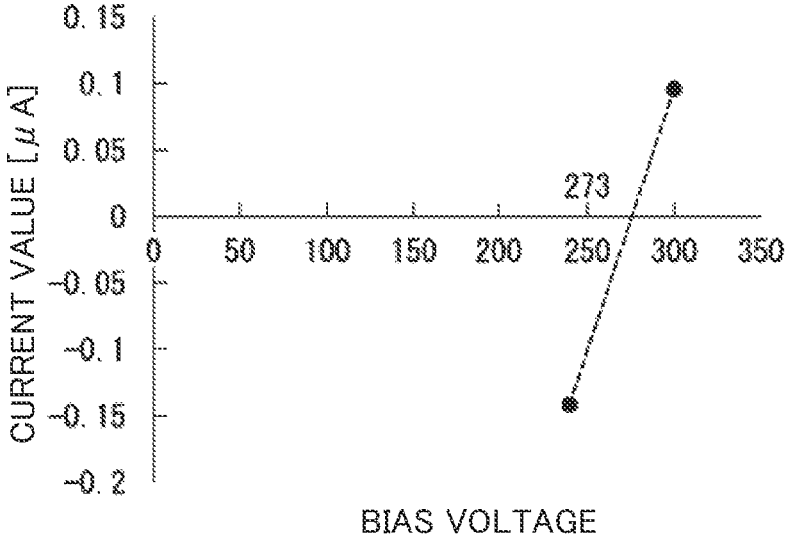
FIG. 19 is a graph showing a relation between the bias voltage and the developing current, shown in FIG. 18.

Referring to FIG. 18 and FIG. 19, the surface potential calculated by the image forming apparatus 1 according to the second working example will be described hereunder.

FIG. 18 is a table showing the developing currents, measured when two levels of bias voltages are applied to the developing roller 641 in the image forming apparatus 1 according to the second working example, in the first blank forming period and the second blank forming period.

FIG. 19 is a graph showing a relation between the bias voltage and the average developing current, shown in FIG. 18. In FIG. 19, the vertical axis represents the developing current, and the horizontal axis represents the bias voltage.

In the second working example, when the bias voltage of 240[V] was applied in the first blank forming period, the measured developing current was −0.16 [μA]. When the bias voltage of 300[V] was applied in the second blank forming period, the measured developing current was 0.11 [μA].

As shown in FIG. 19, the surface potential was calculated as 273[V], in the image forming apparatus 1 according to the second working example.

Figure 20:
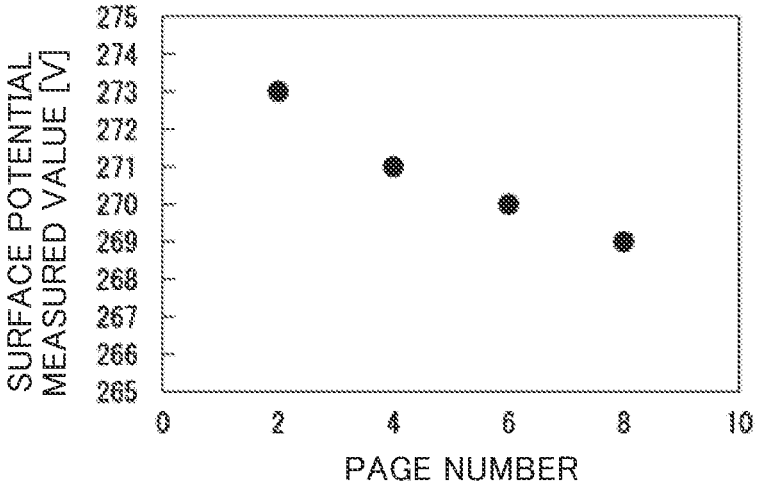
FIG. 20 is a graph showing the transition of the surface potential, calculated with respect to every second page, in the image forming apparatus according to the second working example.

FIG. 20 is a graph showing the transition of the surface potential, calculated with respect to every second page, in the image forming apparatus 1 according to the second working example. In FIG. 20, the vertical axis represents the surface potential, and the horizontal axis represents the page number.

As is apparent from FIG. 20, the surface potential gradually declines toward the posterior pages.

Although the difference in bias voltages to be applied was set to 60 V at maximum, in the second working example, the difference may be 100 V at maximum, without limitation to the above. It is preferable, however, that the difference in bias voltages to be applied is approximately 50 V.

In the second working example, the amorphous silicon drum was employed as the photoconductor drum 65. However, without limitation to the above, the positive-charging organic photoconductor drum may be employed. When the amorphous silicon drum is employed as the photoconductor drum 65, the dielectric constant of the photosensitive layer is higher than that of the positive-charging organic photoconductor drum, and therefore the current flow is encouraged and the carrier resistance is reduced, which leads to higher measurement accuracy.

In addition, although the dual-component developing agent is employed in the second working example, a single-component developing agent may be employed, without limitation to the above.

Now, the current monitored by the existing electrophotography apparatus is susceptible to the secular changes of the photosensitive body or the charging components, and is therefore unstable and prone to involve an error. Accordingly, the accuracy of the surface potential on the photosensitive body may be impaired.

With the configuration according to the first and second embodiments, in contrast, the surface potential of the image carrier can be obtained with high accuracy, without depending on expensive sensors such as a surface potential sensor.

The first and second embodiments have been described as above, with reference to the drawings, namely FIG. 1 to FIG. 20. However, the disclosure is not limited to the first and second embodiments, but may be implemented in various manners without departing from the scope of the disclosure. The drawings schematically illustrate the essential elements for the sake of ease in understanding, and the thickness, length, or the number of pieces of the illustrated elements may be different from the actual ones. Further, the material, shape, or size of the elements referred to in the first and second embodiments are merely exemplary, and may be modified as desired, without substantially compromising the benefits provided by the disclosure.

INDUSTRIAL APPLICABILITY

The disclosure is applicable to the field of image forming apparatuses.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

an image carrier on a surface of which an electrostatic latent image is formed;

a charging device that electrically charges the image carrier;

a developing device that forms a toner image, by supplying toner to the image carrier and developing the electrostatic latent image formed on the image carrier;

a developing power source that applies a predetermined bias voltage to the developing device;

a current measuring device that measures a developing current flowing in the developing device;

a processor that acts, by executing a control program, as a calculator that calculates a surface potential of the image carrier, on a basis of the developing current measured by the measuring device; and a transport mechanism that sequentially transports recording media one by one, wherein the developing device forms, by sequentially forming a plurality of the toner images for forming images on a predetermined printing region in each of a plurality of recording media in a job, the image and a blank region on each of the plurality of recording media, the current measuring device measures the developing current, in at least one of a blank forming period in which the developing device forms the blank region, and a period between recording media corresponding to a period between two of the recording media being transported by the transport mechanism, and the calculator calculates an average value of a plurality of the developing currents measured by the current measuring device, with respect to each of jobs, and calculates the surface potential on a basis of the average value.

2. The image forming apparatus according to claim 1, wherein the developing power source applies different bias voltages with respect to each of the jobs, to the developing device.

3. The image forming apparatus according to claim 2, wherein the developing power source applies, as the different bias voltages, a voltage lower than an assumed surface potential in a period in which the toner image is formed, and a voltage higher than the assumed surface potential, to the developing device.

4. The image forming apparatus according to claim 1,
wherein the calculator excludes, from the calculation of the surface potential, the developing current measured in at least one of the blank forming period, in which the blank region is formed because of formation of the toner image having a coverage rate higher than a predetermined threshold, and the period between recording media immediately after the formation of the toner image.

5. The image forming apparatus according to claim 1,
wherein the processor further acts as a control device that determines the bias voltage on a basis of the surface potential calculated by the calculator, and
the developing power source applies the bias voltage determined by the control device to the developing device, when a next toner image is to be formed.

6. An image forming apparatus comprising:
an image carrier on a surface of which an electrostatic latent image is formed;
a charging device that electrically charges the image carrier;
a developing device that forms a toner image, by supplying toner to the image carrier and developing the electrostatic latent image formed on the image carrier;
a developing power source that applies a predetermined bias voltage to the developing device;
a current measuring device that measures a developing current flowing in the developing device; and
a processor that acts, by executing a control program, as a calculator that calculates a surface potential of the image carrier, on a basis of the developing current measured by the measuring device,
wherein the developing device forms, by forming the toner image for forming an image on a predetermined printing region in a recording medium, the image and a blank region on the recording medium, and
the current measuring device measures the developing current, in a blank forming period in which the developing device forms the blank region,
wherein the calculator excludes, from the calculation of the surface potential, the developing current measured in the blank forming period, in which the blank region is formed because of formation of the toner image having a coverage rate higher than a predetermined threshold.

7. The image forming apparatus according to claim 6,
wherein the developing device forms a plurality of the blank regions on one recording medium,
the developing power source applies a first bias voltage to the developing device, in a first blank forming period in which a part of a plurality of the blank regions is formed,
the current measuring device measures a first developing current in the first blank forming period,
the developing power source applies a second bias voltage to the developing device, in a second blank forming period in which the plurality of blank regions other than the part thereof is formed,
the current measuring device measures a second developing current in the second blank forming period, and
the calculator calculates the surface potential, on a basis of the first developing current and the second developing current.

8. The image forming apparatus according to claim 7,
wherein the developing device forms at least one of the plurality of blank regions in the first blank forming period, and forms at least one of the plurality of blank regions in the second blank forming period.

9. The image forming apparatus according to claim 6,
wherein the processor further acts as a control device that determines the bias voltage on a basis of the surface potential calculated by the calculator, and
the developing power source applies the bias voltage determined by the control device to the developing device, when a next toner image is to be formed.

10. The image forming apparatus according to claim 9,
wherein the developing device sequentially forms a plurality of the toner images for forming images on the printing region in each of a plurality of recording media, in a job, and
the developing power source applies the bias voltage, determined by the control device on a basis of the surface potential calculated by the calculator at a point halfway of the job, to the developing device when a next and a subsequent one of the toner images are to be formed, in the job.

11. The image forming apparatus according to claim 10,
wherein the calculator recalculates the surface potential, when the surface potential calculated at the point halfway of the job is different from the surface potential calculated earlier than the point halfway of the job, by an extent equal to or larger than a predetermined reference value.

* * * * *